US006923438B2

(12) United States Patent
Matsuyama et al.

(10) Patent No.: US 6,923,438 B2
(45) Date of Patent: Aug. 2, 2005

(54) DELIVERED SHEET STACKING TRAY AND IMAGE FORMING DEVICE HAVING THE SAME

(75) Inventors: Kazuhiro Matsuyama, Ikoma (JP); Toshio Yamanaka, Yao (JP); Atsushi Ide, Nara (JP); Yoshinobu Tateishi, Nara (JP); Kenzo Yoshida, Ikoma (JP); Fumikazu Shimanuki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 158 days.

(21) Appl. No.: 10/452,057

(22) Filed: Jun. 3, 2003

(65) Prior Publication Data

US 2003/0222392 A1 Dec. 4, 2003

(30) Foreign Application Priority Data

Jun. 3, 2002 (JP) ..... 2002-161986
Jun. 3, 2002 (JP) ..... 2002-162013

(51) Int. Cl.[7] ..... B65H 31/00
(52) U.S. Cl. ..... 271/207
(58) Field of Search ..... 271/207

(56) References Cited

U.S. PATENT DOCUMENTS 6,260,843 B1 * 7/2001 Hoshimura et al. ..... 271/213
6,398,213 B1 * 6/2002 Wurschum et al. ..... 271/213

FOREIGN PATENT DOCUMENTS

DE 3916039 * 11/1990 ..... B65H/31/00
EP 0 237 026 * 10/1987 ..... B65H/31/20
JP 59-86546 * 5/1984 ..... B65H/31/02
JP 3-152058 * 6/1991 ..... B65H/31/36
JP 5-201603 A 8/1993
JP 5-294538 * 11/1993 ..... B65H/31/22
JP 8-339105 A 12/1996
JP 9-106238 A 4/1997

* cited by examiner

*Primary Examiner*—Donald P. Walsh
*Assistant Examiner*—Kenneth W. Bower
(74) *Attorney, Agent, or Firm*—Birch, Stewart, Kolasch, & Birch, LLP

(57) ABSTRACT

The delivered sheet stacking tray has a delivered sheet stacking surface, provided on an upside of an image forming section, which extends in a sheet-transporting direction so that a transporting-direction end of the delivered sheet stacking surface is opened toward a lateral outside of the image forming device body, wherein the delivered sheet stacking surface has a sheet removing concave which extends from (a) the transporting-direction end via (b) a stacking area of a maximum size sheet to (c) a stacking area of a minimum size sheet so that the sheet removing concave is positioned within an area ranging from the stacking area of the maximum size sheet to the stacking area of the minimum size sheet, and the sheet removing concave is formed substantially in parallel to a line linking (i) a corner portion of the stacking area of the maximum size sheet which corner portion is positioned on a downstream side in the transporting direction and on a front side of the image forming device to (ii) a corner portion of the stacking area of the minimum size sheet which corner portion is positioned on the downstream side in the transporting direction and on the front side of the image forming device, thereby realizing a preferable stacking condition of sheets on the delivered sheet stacking surface, and making it easy to remove the sheets.

47 Claims, 21 Drawing Sheets

DELIVERED SHEET STACKING TRAY AND IMAGE FORMING DEVICE HAVING THE SAME

FIELD OF THE INVENTION

The present invention relates to a delivered sheet stacking tray used in an image forming device such as a printer, a copying machine, a facsimile, and a complex machine thereof, and relates to an image forming device having the delivered sheet stacking tray. Specifically, the present invention relates to a delivered sheet stacking tray whose sheet stacking surface, on which delivered sheets are stacked, is formed so that it is easy to remove the sheets, and relates to an image forming device having the delivered sheet stacking tray.

BACKGROUND OF THE INVENTION

In an image forming device such as a copying machine and a printer, sheets on which images have been formed are delivered and stacked on a delivered sheet stacking section externally provided on a body of the image forming device.

The delivered sheet stacking section is conventionally provided with it externally protruding from the image forming device. Recently, the image forming device has become such a system that it is possible to install various kinds of peripheral devices to a main body. With such improvement, the main body has been made smaller and has occupied less space. As a result, the delivered sheet stacking section is provided on an upside of an image forming section in the main body.

However, in such conventional image forming device, it is often that a top portion of the image forming section has an image reading device. Thus, in a case where the delivered sheet stacking section is provided on the upside of the image forming section and below the image reading device, there occurs such a problem that it is difficult to remove the sheets delivered to the delivered sheet stacking section.

Thus, for example, Japanese Unexamined Patent Publication No. 201603/1993 (Tokukaihei 5-201603)(Publication date: Aug. 10, 1993) and Japanese Unexamined Patent Publication No. 339105/1996 (Tokukaihei 8-339105) (Publication date: Dec. 24, 1996) disclose the following image forming device. As shown in FIG. 21, a delivered sheet stacking tray 601 is formed so that: sheets are delivered from a left side of an image forming device 600 to a sheet stacking surface 602, and an opening concave 604 positioned lower than the sheet stacking surface 602 is provided on the image forming device 600 so as to be positioned below and on the side of an operation section 603, that is, on a front side of the image forming device 600.

Compared with a case where there is no opening concave 604 positioned lower than the sheet stacking surface 602, it is somewhat easy to remove the delivered sheets in this arrangement, but there occurs such a new problem that: a side edge of the sheet has to pass over the opening concave 602 existing on a part of a direction in which the sheet is transported, and this deteriorates a condition under which the sheets are stacked on the sheet stacking surface 602, so that it is difficult to align the delivered sheets. That is, a side edge of the sheet falling in the opening concave 604 hits a brim wall of the opening concave 604 which brim wall is positioned on the down stream side in a delivering direction, so that directions in which the sheets are delivered are not uniformed.

Further, there occurs such a problem that: when an operator performs operations standing near the image forming device, it is difficult to put his/her hand to the delivered sheet stacking tray 601

Moreover, this problem occurs also in a case where there is no image reading device above the image forming device, so that it is difficult to align the sheets, and it is difficult for the operator to put his/her hand to the delivered sheet stacking tray upon removing the sheets. Specifically, when the operator performs operations standing near the image forming device, it is difficult to insert his/her hand to the delivered sheet stacking tray.

SUMMARY OF THE INVENTION

The object of the present invention is to provide a delivered sheet stacking tray and an image forming device having the delivered sheet stacking tray which realize a preferable stacking condition of sheets on a delivered stacking surface and make it easy to remove the sheets.

In order to achieve the foregoing object, a first delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: the delivered sheet stacking surface has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and the sheet removing concave is formed substantially in parallel to a line linking (ii) a corner portion of the stacking area of the maximum size sheet which corner portion is positioned on a downstream side in a transporting direction and on a front side of the image forming device to (i) a corner portion of the stacking area of the small size sheet which corner portion is positioned on the downstream side in the transporting direction and on the front side of the image forming device.

In order to achieve the foregoing object, a first image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: the delivered sheet stacking surface of the delivered sheet stacking tray has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and the sheet removing concave is formed substantially in parallel to a line linking (ii) a corner portion of the stacking area of the maximum size sheet which corner portion is positioned on a downstream side in a transporting direction and on a front side of the body of the image forming device to (i) a corner portion of the stacking area of the small size sheet which corner portion is positioned on the downstream side in the transporting direction and on the front side of the body of the image forming device.

In the first delivered sheet stacking tray, the delivered sheet stacking surface has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet.

Note that, the front side of the image forming device is a side positioned nearest to the operator operating the image forming device. Hereinbelow, the front side is referred to also as an operation side.

Thus, the delivered sheet stacking surface has the sheet removing concave which exists in a part of a direction in which the delivered sheet is transported, but the sheet removing concave is formed along the direction in which the sheet is transported.

Further, the sheet removing concave is formed so as to be positioned within an area ranging from the stacking area of the maximum size sheet to a stacking area of the small size sheet. Thus, both sides of the stacked sheet, that are parallel to a direction in which sheets ranging from the maximum size sheet to the minimum size sheet are delivered, are supported by the delivered sheet stacking surface, so that this arrangement does not bring about the following problem: a stacking condition of the sheets on the delivered sheet stacking surface is deteriorated, so that it becomes difficult to align the sheets.

Further, in order to solve such a problem that it is difficult for the operator to insert his/her hand to the delivered sheet stacking surface when the operator performs operations standing near the image forming device, the sheet removing concave is formed along the direction in which the sheet is transported, so that the operator can naturally and easily insert his/her hand from the lateral outside of the image forming device to the area where the sheets are stacked.

Moreover, the sheet removing concave is formed substantially in parallel to a line linking (ii) a corner portion of the stacking area of the maximum size sheet which corner portion is positioned on a downstream side in a transporting direction and on a front side of the body of the image forming device to (i) a corner portion of the stacking area of the small size sheet which corner portion is positioned on the downstream side in the transporting direction and on the front side of the body of the image forming device.

As a result, it is possible to provide a delivered sheet stacking tray and an image forming device having the delivered sheet stacking tray which realize a preferable stacking condition of sheets on a delivered stacking surface and make it easy to remove the sheets.

Further, in order to achieve the foregoing object, a second delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of the stacking area of the maximum size sheet which corner portion is positioned on a downstream side in a transporting direction and on a front side of the image forming device to (i) a corner portion of a stacking area of a small size sheet smaller than the maximum size sheet which corner portion is positioned on the downstream side in the transporting direction and on the front side of the image forming device so that the sheet removing concave extends from the transporting-direction end of the delivered sheet stacking surface.

Further, in order to achieve the foregoing object, a second image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of a stacking area of a maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface.

According to the second delivered sheet stacking tray, an end of the sheet which end is positioned on a back side of the image forming device is supported by the delivered sheet stacking surface upon delivering the sheet to the delivered sheet stacking surface. Further, the delivered sheet stacking surface has a sheet removing concave which includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface.

Thus, the delivered sheet stacking surface has the sheet removing concave which exists in a part of a direction in which the delivered sheet is transported, but the sheet removing concave is formed along the direction in which the sheet is transported.

Further, the sheet removing concave includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device. Further, an end of the sheet which end is positioned on a back side of the image forming device is supported by the delivered sheet stacking surface upon delivering the sheet to the delivered sheet stacking surface.

Thus, the delivered sheet stacking surface supports both sides of the stacked sheet that are parallel to a direction in which sheets ranging from the maximum size sheet to the minimum size sheet are delivered, so that this arrangement does not bring about the following problem: a stacking condition of the sheets on the delivered sheet stacking surface is deteriorated, so that it becomes difficult to align the sheets.

Further, in order to solve such a problem that it is difficult for the operator to insert his/her hand to the delivered sheet stacking surface when the operator performs operations standing near the image forming device, the sheet removing concave is formed along the direction in which the sheet is transported, so that the operator can naturally and easily insert his/her hand from the lateral outside of the image forming device to the area where the sheets are stacked.

As a result, it is possible to provide a delivered sheet stacking tray and an image forming device having the delivered sheet stacking tray which realize a preferable stacking condition of sheets on a delivered stacking surface and make it easy to remove the sheets.

In order to achieve the foregoing object, a third delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: the delivered sheet stacking surface has a sheet removing concave which extends from (a) the transporting-direction end via (b) a stacking area of a maximum size sheet to (c) a stacking area of a sheet smaller than the maximum size sheet so that the sheet removing concave is positioned within an area ranging from the stacking area of the maximum size sheet to the stacking area of the small size sheet, and a width of the sheet removing concave becomes wider toward a downstream side in a transporting direction. Note that, the width of the sheet removing concave is a width in a vertical direction with respect to the transporting direction.

In order to achieve the foregoing object, a third image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: the delivered sheet stacking surface of the delivered sheet stacking tray has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and a width of the sheet removing concave becomes wider toward a downstream side in a transporting direction.

According to the third delivered sheet stacking tray, the delivered sheet stacking surface has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet.

Thus, the delivered sheet stacking surface has the sheet removing concave which exists in a part of a direction in which the delivered sheet is transported, but the sheet removing concave is formed along the direction in which the sheet is transported.

Further, the sheet removing concave is formed so as to be positioned within an area ranging from the stacking area of the maximum size sheet to the stacking area of the small size sheet. Thus, the delivered sheet stacking surface supports both sides of the stacked sheet that are parallel to a direction in which sheets ranging from the maximum size sheet to the minimum size sheet are delivered, so that this arrangement does not bring about the following problem: a stacking condition of the sheets on the delivered sheet stacking surface is deteriorated, so that it becomes difficult to align the sheets.

Further, the width of the sheet removing concave becomes wider toward a downstream side in a transporting direction, so that it is possible to easily remove sheets ranging from the minimum size sheet to the maximum size sheet for example.

Further, in order to solve such a problem that it is difficult for the operator to insert his/her hand to the delivered sheet stacking surface when the operator performs operations standing near the image forming device, the sheet removing concave is formed along the direction in which the sheet is transported, and the width of the sheet removing concave becomes wider toward a downstream side in a transporting direction, so that the operator can naturally and easily insert his/her hand from the lateral outside of the image forming device to the area where the sheets are stacked.

As a result, it is possible to provide a delivered sheet stacking tray and an image forming device having the delivered sheet stacking tray which realize a preferable stacking condition of sheets on a delivered stacking surface and make it easy to remove the sheets.

In order to achieve the foregoing object, a fourth delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of the stacking area of the maximum size sheet which corner portion is positioned on a downstream side in a transporting direction and on a front side of the image forming device to (i) a corner portion of a stacking area of a small size sheet smaller than the maximum size sheet which corner portion is positioned on the downstream side in the transporting direction and on the front side of the image forming device so that the sheet removing concave extends from the transporting-direction end of the delivered sheet stacking surface, and a width of the sheet removing concave becomes wider toward a downstream side in a transporting direction.

In order to achieve the foregoing object, a fourth image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface, and a width of the sheet removing concave becomes wider toward a downstream side in a transporting direction.

In addition to an arrangement similar to the second delivered sheet stacking tray, the fourth delivered sheet stacking tray is arranged so that the width of the sheet removing concave becomes wider toward a downstream side in a transporting direction, so that it is possible to easily remove sheets ranging from the minimum size sheet to the maximum size sheet.

Further, in order to solve such a problem that it is difficult for the operator to insert his/her hand to the delivered sheet stacking surface when the operator performs operations standing near the image forming device, the sheet removing concave is formed along the direction in which the sheet is transported, and the width of the sheet removing concave becomes wider toward a downstream side in a transporting direction, so that the operator can naturally and easily insert his/her hand from the lateral outside of the image forming device to the area where the sheets are stacked.

As a result, it is possible to more preferably provide a delivered sheet stacking tray and an image forming device having the delivered sheet stacking tray which realize a preferable stacking condition of sheets on a delivered stacking surface and make it easy to remove the sheets.

For a fuller understanding of the nature and advantages of the invention, reference should be made to the ensuing detailed description taken in conjunction with the accompanying drawings.

DESCRIPTION OF THE EMBODIMENTS

EXAMPLE 1

One embodiment of the present invention is described as follows based on FIG. 1 to FIG. 6.

Figure 2:
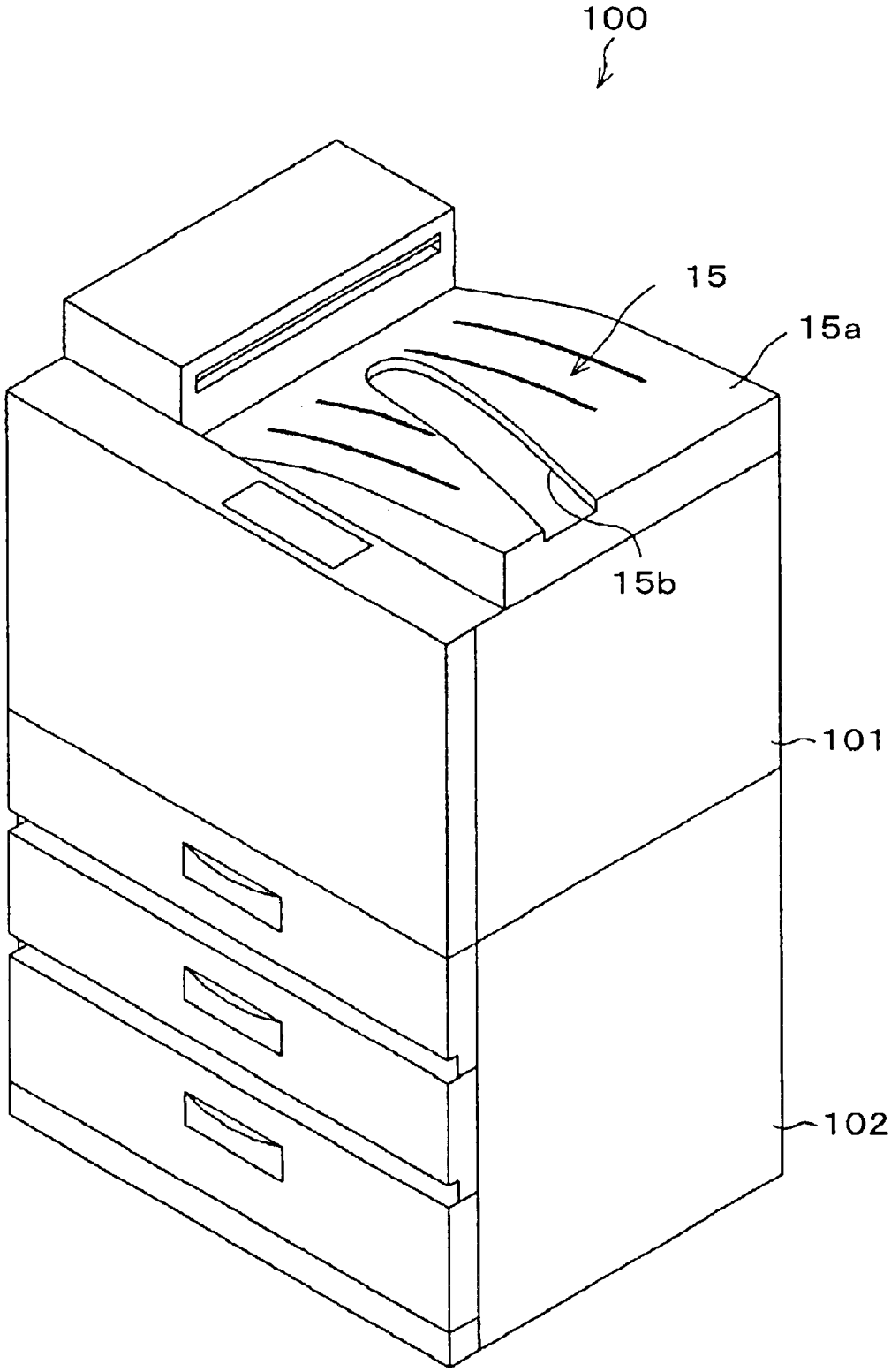
FIG. 2 is a perspective view showing a digital color printer which functions as the image forming device.

As shown in FIG. 2, a digital color printer 100 which functions as an image forming device of the present embodiment forms a polychromatic or monochromatic image on a predetermined sheet used as a recording paper according to image data transmitted from the outside, and includes an image forming section 101 as image forming means and a sheet feeding desk device 102 provided below the image forming section 101.

Figure 3:
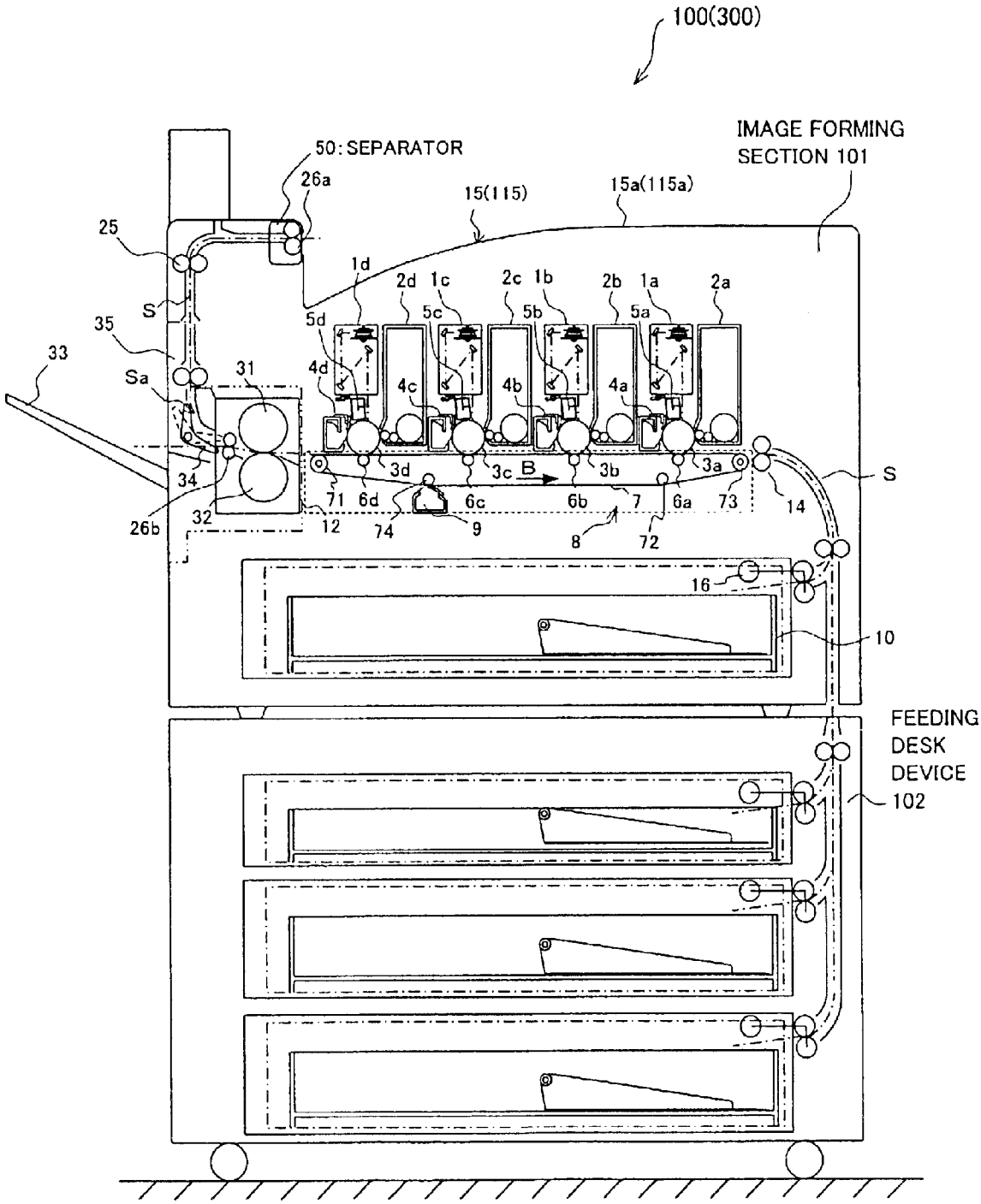
FIG. 3 is a cross sectional view of the digital color printer shown in a front direction.

As shown in FIG. 3, the image forming section 101 includes exposing units 1 (1*a*, 1*b*, 1*c*, and 1*d*), developing devices 2 (2*a*, 2*b*, 2*c*, and 2*d*), photosensitive drums 3 (3*a*, 3*b*, 3*c*, and 3*d*), electrifying devices 5 (5*a*, 5*b*, 5*c*, and 5*d*), cleaner units 4 (4*a*, 4*b*, 4*c*, and 4*d*), a transcribing/transporting belt unit 8, a fixing unit 12, a sheet transport path S, a feeding tray 10, a delivered sheet stacking tray 15, a delivery tray 33, and the like.

Image data used in the image forming section 101 corresponds to a color image using black (K), cyan (C), magenta (M), and yellow (Y). Thus, four exposing units 1 (1*a*, 1*b*, 1*c*, and 1*d*), four developing devices 2 (2*a*, 2*b*, 2*c*, and 2*d*), four photosensitive drums 3 (3*a*, 3*b*, 3*c*, and 3*d*), and four electrifying devices 5 (5*a*, 5*b*, 5*c*, and 5*d*), and four cleaner units 4 (4*a*, 4*b*, 4*c*, and 4*d*) are provided so as to form four kinds of latent images corresponding to the respective colors, and "a" members constitute a black image station, and "b" members constitute a cyan image station, and "c" members constitute a magenta image station, and "d" members constitute an yellow image station.

The photosensitive drums 3 (3*a*, 3*b*, 3*c*, and 3*d*) are disposed substantially in a central position of the image forming section 101. Each electrifying device 5 (5*a*, 5*b*, 5*c*, and 5*d*) is electrifying means for uniformly electrifying a surface of each photosensitive drum 3 (3*a*, 3*b*, 3*c*, and 3*d*) at a predetermined potential, and examples of the electrifying device include not only a contact roller type electrifying device and a brush type electrifying device but also a charger type electrifying device as shown in FIG. 3.

As each exposing unit 1 (1*a*, 1*b*, 1*c*, and 1*d*), a writing head such as an EL (Electro Luminescence) writing head and an LED (Light Emitting Diode) writing head in which light emitting elements disposed in an array manner, or a laser scanning unit (LSU) having a laser irradiating portion and a reflecting mirror is used. Further, the exposing unit 1 exposes each electrified photosensitive drum 3 (3*a*, 3*b*, 3*c*, and 3*d*) corresponding to inputted image data, so as to form an electrostatic latent image corresponding to the image data.

Each developing device 2 (2*a*, 2*b*, 2*c*, and 2*d*) visualizes the electrostatic latent image formed on each photosensitive drum 3 (3*a*, 3*b*, 3*c*, and 3*d*) with toner of K, C, M, and Y. Each cleaner unit 4 (4*a*, 4*b*, 4*c*, and 4*d*) removes and collects toner remaining on a surface of each photosensitive drum 3 (3*a*, 3*b*, 3*c*, and 3*d*) after developing and transcribing the image.

While, the transcribing/transporting belt unit 8 disposed below each photosensitive drum 3 (3*a*, 3*b*, 3*c*, and 3*d*) has a transcribing belt 7, a transcribing belt driving roller 71, a transcribing belt tension roller 72, a transcribing belt following roller 73, a transcribing belt supporting roller 74, transcribing rollers 6 (6*a*, 6*b*, 6*c*, and 6*d*), and a transcribing belt cleaning unit 9.

The transcribing belt driving roller 71, the transcribing belt tension roller 72, the transcribing roller 6 (6*a*, 6*b*, 6*c*, and 6*d*), the transcribing belt following roller 73, and the transcribing belt supporting roller 74 stretch the transcribing belt in a suspending manner, and drive the transcribing belt 7 to rotate in a B direction shown in FIG. 3. Each transcribing roller 6 (6*a*, 6*b*, 6*c*, and 6*d*) is supported by a frame (not shown) inside the transcribing belt unit 8 in a rotatable manner, and transcribes a toner image of each photosensitive drum 3 (3*a*, 3*b*, 3*c*, and 3*d*) onto a sheet that is absorbed by the transcribing belt 7 and is transported.

The transcribing belt 7 is provided so as to be in contact with each photosensitive drum 3 (3*a*, 3*b*, 3*c*, and 3*d*). Further, the transcribing belt 7 enables the toner images of respective colors that have been formed on photosensitive drums 3 (3*a*, 3*b*, 3*c*, and 3*d*) to sequentially overlap with each other upon transcription, so as to form a polychromatic toner image. The transcribing belt 7 is formed in an endless shape using a film whose thickness is approximately 100 $\mu$m.

The toner image is transcribed from each photosensitive drum 3 (3*a*, 3*b*, 3*c*, and 3*d*) onto the sheet by means of each transcribing roller 6 (6*a*, 6*b*, 6*c*, and 6*d*) which is in contact with a back side of the transcribing belt 7. In order to transcribe the image toner, for example, a high voltage whose polarity (+) is reverse to an electrifying polarity (−) of the toner is applied to each transcribing roller 6 (6*a*, 6*b*, 6*c*, and 6*d*).

Further, each transcribing roller 6 (6*a*, 6*b*, 6*c*, and 6*d*) is a roller that is made as follows: for example, a metallic axis of stainless etc. whose diameter ranges from 8 mm to 10 mm is used as a base material, and its surface is covered with a conductive elastic material (for example, EPDM (ethylene propylene dien monomer), foaming urethane, and the like). The conductive elastic material enables a high voltage to be uniformly applied to a recording paper. Note that, in the present embodiment, each transcribing roller 6 (6*a*, 6*b*, 6*c*, and 6*d*) is used as a transcribing electrode but a brush transparent electrode 12 and the like can be used instead of the transcribing roller 6.

Further, toner that has adhered to the transcribing belt 7 upon contacting each photosensitive drum 3 (3*a*, 3*b*, 3*c*, and 3*d*) causes a back side of the recording paper to be contaminated. Thus, the transcribing cleaning unit 9 removes and collects the toner. The transcribing cleaning unit 9 has a cleaning blade as a cleaning section which is in contact with the transcribing belt 7 for example, and the cleaning belt 7 which is in contact with the cleaning blade is supported by a back side of a transcribing belt support roller 74.

The feeding tray 10 is a tray on which sheets for forming images are stored, and is provided below the image forming section 101 of the digital color printer 100.

Further, the delivered sheet stacking tray 15 provided on an upside of the digital color printer 100 is a tray on which printed sheets are stacked in a face-down manner. Note that, the delivered sheet stacking tray 15 is detailed later.

The delivery tray 33 provided on a side portion of the digital color printer 100 is a tray on which sheets having images thereon are stacked in a face-up manner.

The image forming section 101 further includes an S-shaped sheet transport path S for transporting sheets stored in the feeding tray 10 via the transcribing/transporting unit 8 and the fixing unit 12. Further, in a periphery of the sheet transport path S extending from the feeding tray 10 to the delivered sheet stacking tray 15 and the delivery tray 33, there are disposed a pick up roller 16, a resist roller 14, the fixing unit 12, a transporting-direction switching gate 34, a transport roller 25 for transporting sheets, a delivery-roller pair 26*a* which functions as sheet delivering means for delivering the sheets to the delivered sheet stacking tray 15, and a delivery-roller pair 26*b* for delivering sheets to the delivery tray 33.

A plurality of transport rollers 25 promote and support transportation of the sheets, and are provided along the sheet transport path S. The pick up roller 16 is provided on an end of the feeding tray 10, and functions as an introducing roller for supplying the sheets from the feeding tray 10 to the sheet transport path S one by one.

The transporting-direction switching gate 34 is provided so as to be rotatable around a side cover 35, and shifts from a state shown by a continuous line to a state shown by a broken line, so that the sheets are separated from the sheet transport path, thereby delivering the sheets to the delivery tray 33. In a case of the state shown by the continuous line, the sheets pass through a transport path Sa which is a part of the sheet transport path S formed between the side cover 35 and the transporting-direction switching gate 34, so as to be delivered to the delivered sheet stacking tray 15 positioned thereabove.

Further, the resist roller 14 holds the sheet transported on the sheet transport path S for a while, and transports the sheet in combination with rotation of each photosensitive drums 3 (3*a*, 3*b*, 3*c*, and 3*d*) in such timing that it is possible to preferably transcribe the toner images formed on each photosensitive drums 3 (3*a*, 3*b*, 3*c*, and 3*d*) onto the sheet in a multiplex manner.

That is, the resist roller 14 transports the sheet so that an end portion of the toner image formed on each photosensitive drum 3 (3*a*, 3*b*, 3*c*, and 3*d*) corresponds to an end portion of an image forming area, in accordance with a detection signal outputted by pre-resist detection switch (not shown).

The fixing unit 12 has a heat roller 31, a pressing roller 32, and the like. The heat roller 31 and the pressing roller 32 rotate with the sheet sandwiched therebetween. Further, the heat roller 31 has a fixing temperature controlled by a controlling section (not shown) based on a temperature detection value (not shown), and thermally presses the sheet, so that the polychromatic toner image transcribed onto the sheet is fused, mixed, and pressed, so that the toner image is thermally fixed on the sheet.

Note that, the sheet on which the polychromatic toner image has been fixed is transported to an inverted sheet transport path of the sheet transport path S by the transport rollers 25, and the inverted sheet is delivered to the delivered sheet stacking tray 15 with the toner image facing downward.

Further, the separator 50 which functions as sorting means shown in FIG. 3 causes the delivery-roller pair 26*a* which functions as the sheet delivering means to shift the sheet in a vertical direction with respect to a direction in which the sheet is delivered, so as to sort the sheet. How to shift the sheet is as follows: gear drive obtained by a stepping motor (not shown), a rack pinion (not shown), and the like causes the delivery-roller pair 26*a* and a housing (not shown) of the delivery-roller pair 26*a* to integrally move, so as to shift the sheet in a vertical direction with respect to the direction in which the sheet is delivered.

In the present embodiment, the digital color printer 100 is specifically characterized in the delivered sheet stacking tray 15 formed on the upside of the image forming section 101.

Figure 1:
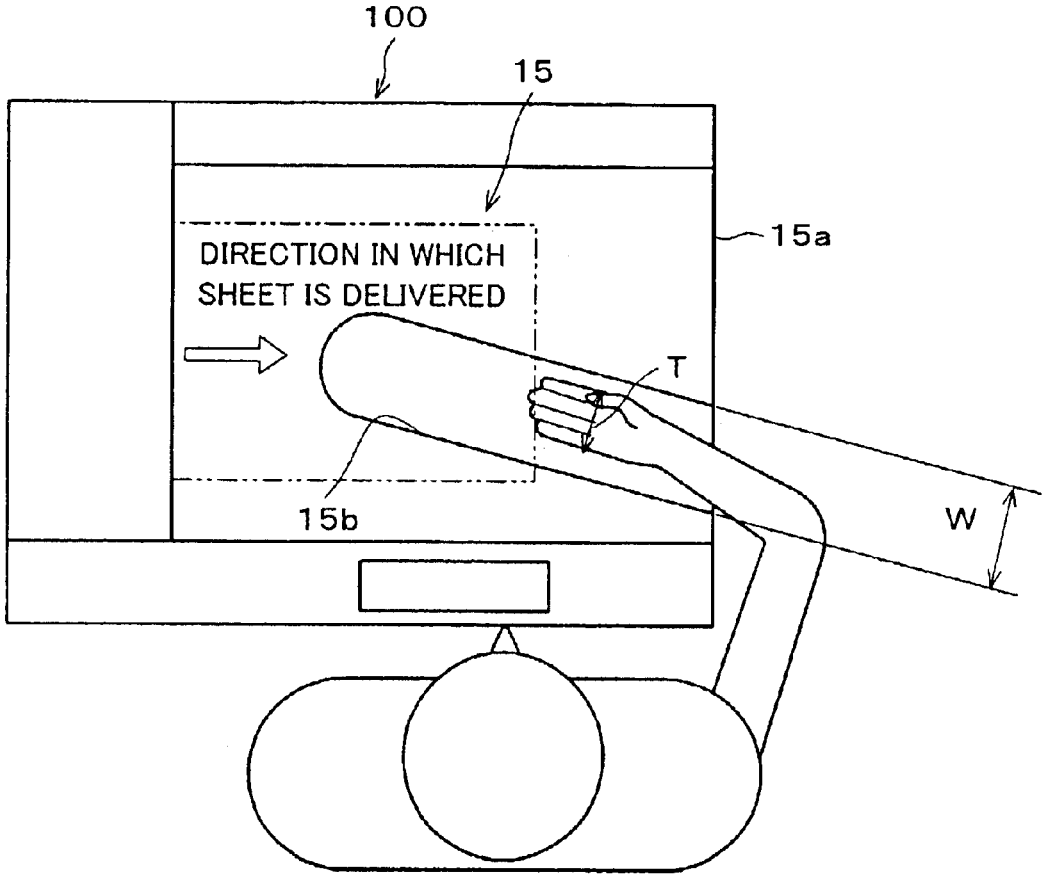
FIG. 1 shows one embodiment of a delivered sheet stacking tray and an image forming device having the same according to the present invention, and is a plan view showing a condition under which an operator inserts his/her hand along a sheet removing concave to a delivered sheet stacking surface.

That is, the delivered sheet stacking tray 15 of the present embodiment includes: the delivered sheet stacking surface 15*a* which extends in a direction in which the sheet is transported; and the sheet removing concave 15*b* which functions as a first sheet removing concave positioned lower than the delivered sheet stacking surface 15*a* as shown in FIG. 1. As shown in FIG. 3, in the delivered sheet stacking surface 15*a*, a portion positioned vertically downward with respect to the delivery-roller pair 26*a* is lower than other portion of the delivered sheet stacking surface 15*a* so as to surely stack some amounts (400 to 500 sheets) of delivered sheets that have free-fallen, and a position of the delivered sheet stacking surface 15*a* becomes higher as further from the delivery-roller pair 26*a*.

In this arrangement, the sheets which have been delivered from the delivery-roller pair 26*a* slide along a slant of the delivered sheet stacking surface 15, and a side wall of the delivered sheet stacking tray 15 which is positioned on the side of the delivery-roller pair 26*a* causes the sheets to be uniformly stacked, thereby making it easy to align the plural sheets.

Here, a depth of the sheet removing concave 15*b* shown in FIG. 2 is substantially as long as a thickness of a finger so that it is easy to remove the sheets stacked on the sheet stacking surface 15*a*, and is approximately 11 mm for example in the present embodiment. Further, as shown in FIG. 1, a width (W) of the sheet removing concave 15*b* is a bit wider than a width (T) of four fingers excluding a thumb folded on a palm, and is approximately 90 mm for example in the present embodiment. Thus, it is easy for the operator to insert his/her hand from the outside of the digital color printer 100 to the delivered sheet stacking tray 15.

Further, the sheet removing concave 15*b* is formed on the delivered sheet stacking surface 15*a* so that: when the sheets are delivered, both sides of any size sheet that are in parallel to a delivering direction do not positioned in any concave, and the sheet stacking surface 15*a* surely supports the both sides. Thus, this arrangement realizes a preferable loading condition of sheets on the delivered sheet stacking surface 15*a* and makes it easy to align the sheets.

Further, the sheet removing concave 15*b* is formed on the delivered sheet stacking surface 15*a* so as to approach an operation side of the digital color printer 100 as the sheet removing concave 15*b* extends from (i) a portion which is positioned in a central part of a transport line and inside an end of a minimum size sheet such as a post card size sheet to (ii) a portion which is positioned outside an end of a maximum size sheet such as an A4-wide sheet. Thus, it is easy for the operator to insert his/her hand from the outside of the digital color printer 100 to the delivered sheet stacking tray 15.

Figure 4:
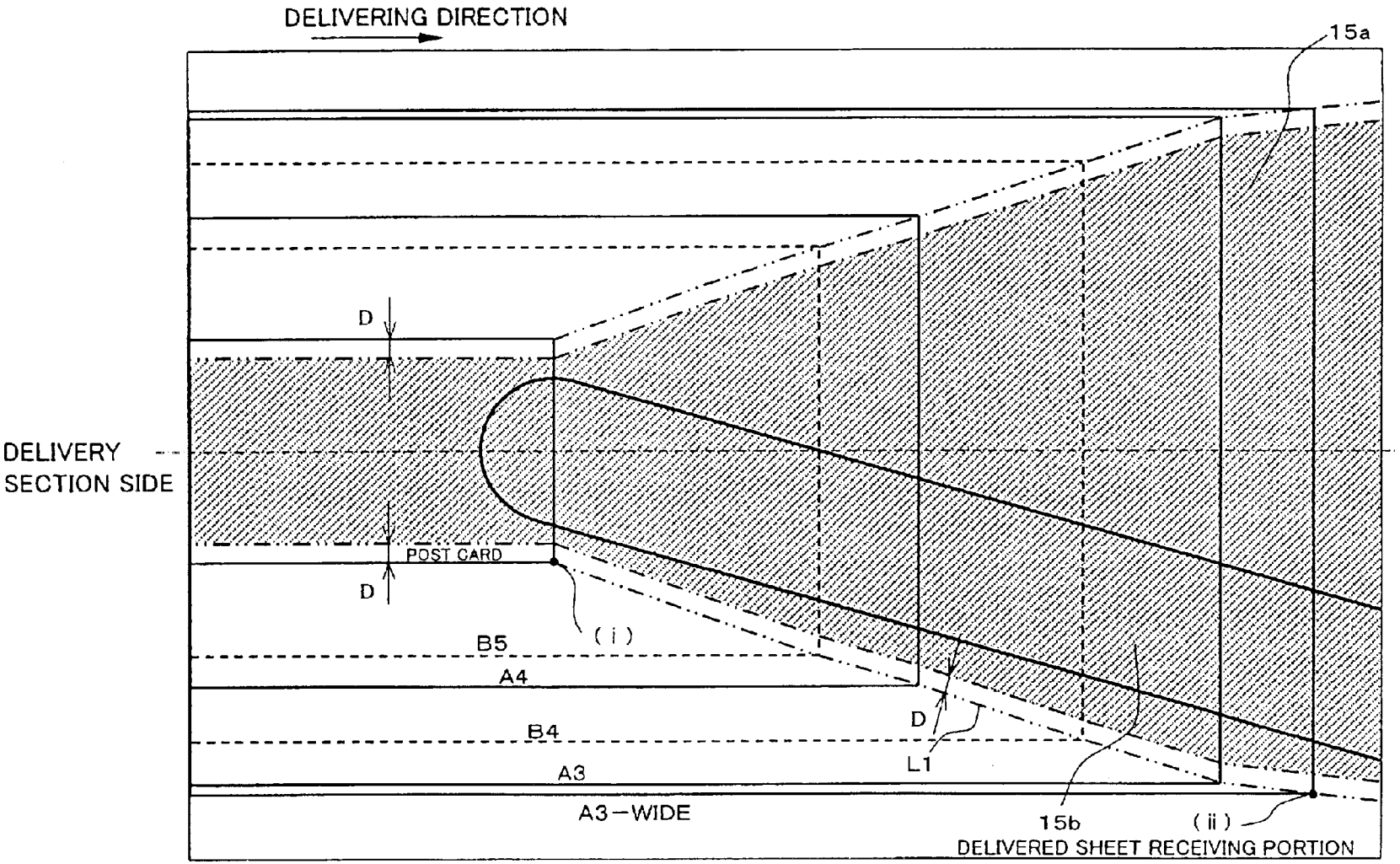
FIG. 4 is a plan view of a sheet removing concave, provided on the delivered sheet stacking surface, which is designed in terms of various sizes of delivered sheets.

Further, as shown in FIG. 4, the sheet removing concave 15*b* is formed substantially in parallel to a line L1 linking (i) an operation-side-end corner, regarded as a corner portion of a minimum size sheet, which is positioned in a central portion of a transport line and inside an end of the minimum size sheet such as a post card size sheet to (ii) an operation-side end corner which is regarded as a corner portion of the maximum size sheet such as an A3-wide sheet. That is, as shown by a shaded area in FIG. 4, there is a distance D to the line L1 so as to cover (a) the uneven transportation of the sheets deviating in a vertical direction with respect to a direction in which the sheet is transported and (b) unevenness in the sheet sizes. It may be preferable that a size of the distance D is not less than approximately 5 mm. Thus, the sheet removing concave 15*b* provided on the delivered sheet stacking surface 15*a* comes nearest to the operator as it extends toward an outside of the digital color printer 100, so that the operator can naturally and easily insert his/her hand from the outside of the digital color printer 100 to the delivered sheet stacking tray 15.

Figure 5:
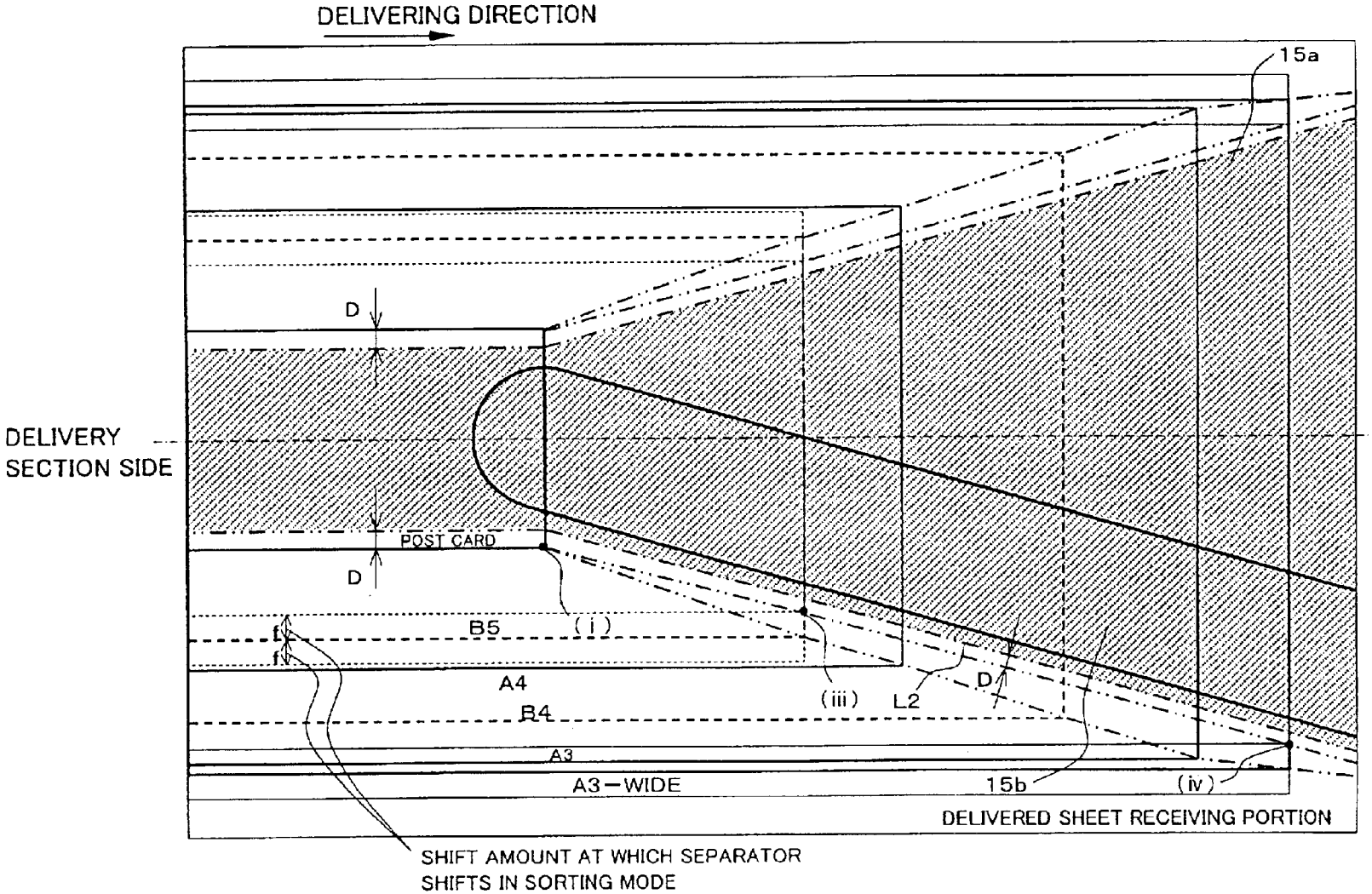
FIG. 5 is a plan view of a sheet removing concave in a case where a separator for sorting the sheets is provided, and the sheet removing concave is provided on the delivered sheet stacking surface with various sizes of delivered sheets taken into consideration.

Further, when the delivery-roller pair 26*a* includes a separator 50 having a sorting function for shifting the sheet in a vertical direction with respect to a delivering direction upon delivering the sheet, as shown in FIG. 5, the sheet removing concave 15*b* is formed inside a line L2. The line L2 is formed by linking (i) an operation-side end corner, regarded as a corner portion of a minimum size sheet, which is positioned in a central portion of a transport line and inside an end of a minimum size sheet such as a post card size sheet, via (ii) an operation-side end corner regarded as a corner portion of at least a minimum size sheet such as B5-vertical size sheet which is sortable upon shifting the sheet away from the operator, to (iii) an operation-side end corner regarded as a corner portion of a maximum size sheet such as an A3-wide sheet. That is, as shown by a shaded area in FIG. 5, there is a distance D to the line L2 so as to cover (a) the uneven transportation of the sheets deviating in a vertical direction with respect to a direction in which the sheet is transported and (b) unevenness in the sheet sizes.

Thus, even when the delivery-roller pair 26*a* has the sorting function for shifting the sheet in a vertical direction with respect to a delivering direction upon delivering the sheet, the operator can easily insert his/her hand from the outside of the digital color printer 100 to the sheet stacking section.

Figure 6:
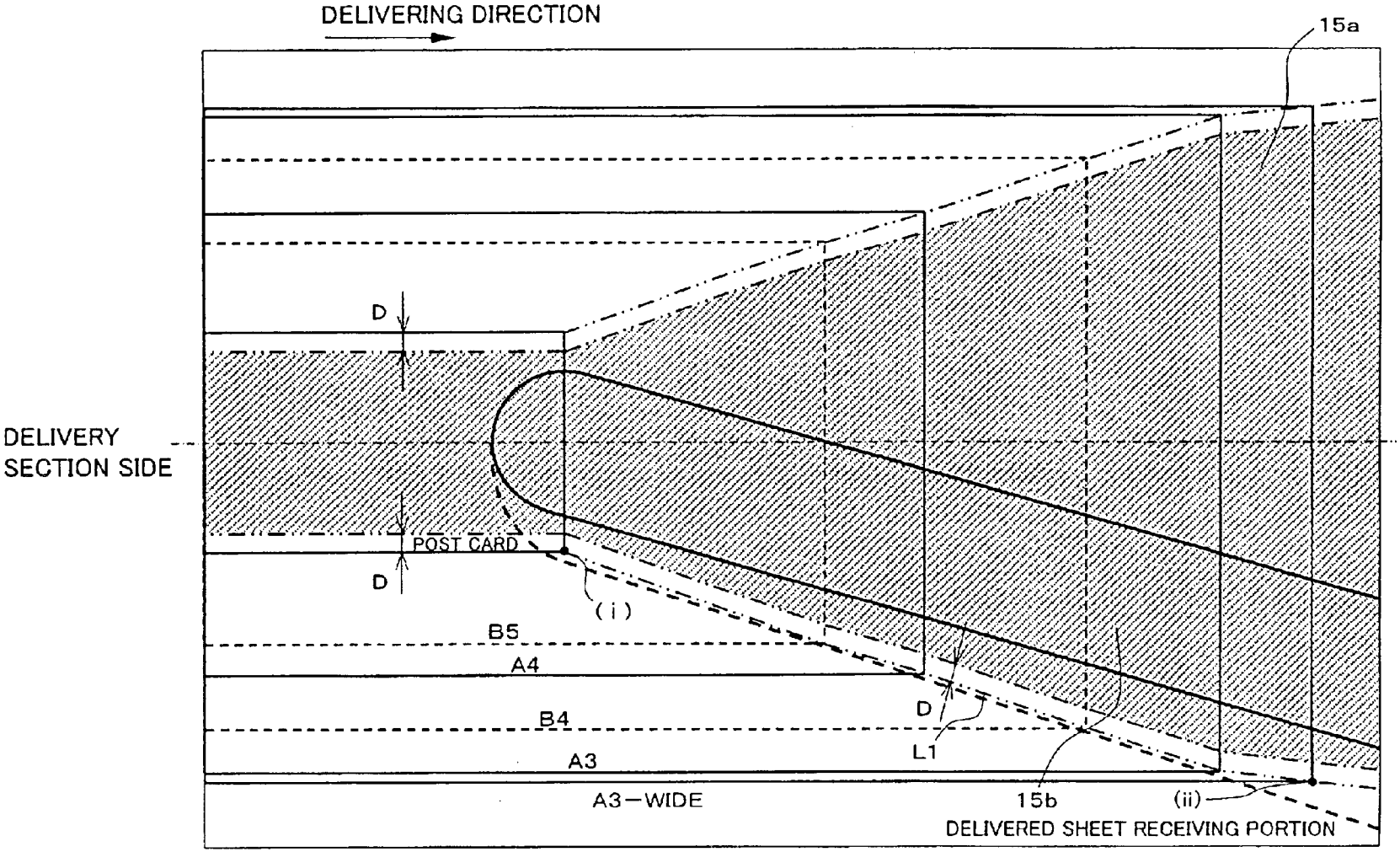
FIG. 6 shows a modification example of the delivered sheet stacking tray and the image forming device having the delivered sheet stacking tray, and is a plan view of the delivered sheet stacking surface which shows an example of a case where the sheet removing concave includes a line L1.

Note that, in the present embodiment, the sheet removing concave 15*b* is formed within an area ranging from a stacking area of the maximum size sheet to a stacking area of the minimum size sheet. However, the arrangement is not limited to this, but as shown in FIG. 6, it may be so arranged that: the sheet removing concave 15*b* which functions as a second sheet removing concave on the delivered sheet stacking surface 15*a* includes a line linking (ii) a corner portion of a stacking area of the maximum size sheet which corner portion is positioned on a downstream side in a transporting direction and is positioned on a front side of the image forming device to (i) a corner portion of the minimum size sheet which corner portion is positioned on the downstream side in the transporting direction and is positioned on the front side of the image forming device, and the sheet removing concave 15*b* extends from a transporting-direction end of the delivered sheet stacking surface.

Thus, at least one side of the delivered sheet in the delivering direction is supported by the delivered sheet stacking surface 15*a*, so that it is possible to obtain a similar effect.

Further, in the foregoing description, the B5-vertical size sheet is used as at least the minimum size sheet which is sortable, but the arrangement is not limited to this. For example, a post-card size sheet can be used.

Further, in the present embodiment, the polychromatic image forming device is described, but it may be so arranged that a single image forming station is provided.

Further, as to the feeding desk device 102, detail description is omitted since it is not featured in the present invention. Note that, in the present embodiment, as shown in FIG. 3, the feeding desk device 102 includes three feeding trays, but the arrangement is not limited to this. A single feeding tray, two feeding trays provided in parallel to each other as tandem trays, a feeding desk which functions merely as a desk, and the like can be installed as required by a user.

In this manner, in the digital color printer 100 and the delivered sheet stacking tray 15 of the present embodiment, the delivered sheet stacking surface 15*a* includes the sheet removing concave 15*b* which extends from the transporting-direction end of the delivered sheet stacking surface 15*a* via the stacking area of the maximum size sheet to the stacking area of the minimum size sheet.

Thus, on the delivered sheet stacking surface 15*a*, the sheet removing concave 15*b* exists in a part of the direction in which the delivered sheet is transported, but the sheet removing concave 15*b* is formed along the direction in which the delivered sheet is transported.

Further, the sheet removing concave 15*b* is formed within an area ranging from the stacking area of the minimum size sheet to the stacking area of the maximum size sheet. Thus, the delivered sheet stacking surface 15*a* surely supports both sides of the stacked sheet that are parallel to a direction in which sheets ranging from the maximum size sheet to the minimum size sheet are delivered, so that this arrangement does not bring about the following problem: a stacking condition of sheets on the delivered sheet stacking surface 15*a* is deteriorated, so that it becomes difficult to align the sheets. Note that, in the present embodiment, the sheet removing concave 15*b* is formed within an area ranging from the stacking area of the minimum size sheet to the stacking area of the maximum size sheet. However, the arrangement is not limited to this, but other arrangement may be made as long as the sheet removing concave 15*b* is positioned within an area ranging from a stacking area of a small size sheet smaller than the maximum size sheet to a stacking area of the maximum size sheet.

Further, in order to solve such a problem that it is difficult for the operator to insert his/her hand to the delivered sheet stacking surface 15*a* when the operator performs operations standing near the image forming device, the sheet removing concave 15*b* is formed along the direction in which the sheet is transported, so that the operator can naturally and easily insert his/her hand from the lateral outside of the digital color printer 100 to the area where the sheets are stacked.

As a result, it is possible to provide the delivered sheet stacking tray 15 and the digital color printer 100 having the delivered sheet stacking tray 15 which realize a preferable stacking condition of sheets on the delivered sheet stacking surface 15*a* and make it easy to remove the sheets.

Further, in the delivered sheet stacking tray 15 and the digital color printer 100 of the present embodiment, an end of the sheet that is positioned on a back side of the digital color printer 100 is supported by the delivered sheet stacking surface 15*a* upon delivering the sheet to the delivered sheet stacking surface 15*a*. While, it is possible to form the sheet removing concave 15*b* which includes the line L1 linking (ii) a corner portion of the stacking area of the maximum size sheet which corner portion is positioned on a downstream side in a transporting direction and on a front side of the digital color printer 100 to (i) a corner portion of the stacking area of a small size sheet such as a minimum size sheet smaller than the maximum size sheet which corner portion is positioned on a downstream side in a transporting direction and the front side of the digital color printer 100 so that the sheet removing concave 15*b* extends from a transporting-direction end of the delivered sheet stacking surface 15*a*.

Thus, on the delivered sheet stacking surface 15*a*, the sheet removing concave 15*b* exists in a part of the direction in which the delivered sheet is transported, but the sheet removing concave 15*b* is formed along the direction in which the delivered sheet is transported.

Further, the delivered sheet stacking surface 15*a* is formed so as to include the line L1 linking (ii) a corner portion of the stacking area of the maximum size sheet which corner portion is positioned on a downstream side in a transporting direction and on a front side of the digital color printer 100 to (i) a corner portion of the stacking area of a small size sheet such as a minimum size sheet smaller than the maximum size sheet which corner portion is positioned on a downstream side of a transporting direction and on a front side of the digital color printer 100. Further, an end of the sheet that is positioned on a back side of the digital color printer 100 is supported by the delivered sheet stacking surface 15*a* upon delivering the sheet to the delivered sheet stacking surface 15*a*.

Thus, at least one side of the delivered sheet, that is in parallel to a direction in which sheets ranging from the maximum size sheet to the minimum size sheet for example are delivered, is supported by the delivered sheet stacking surface 15*a*, so that this arrangement does not bring about the following problem: a stacking condition of sheets on the delivered sheet stacking surface 15*a* is deteriorated, so that it becomes difficult to align the sheets.

Further, in order to solve such a problem that it is difficult for the operator to insert his/her hand to the delivered sheet stacking surface 15*a* when the operator performs operations standing near the image forming device, the sheet removing concave 15*b* is formed along the direction in which the sheet is transported, so that the operator can naturally and easily insert his/her hand from a lateral outside of the digital color printer 100 to the area where the sheets are stacked.

As a result, it is possible to provide the delivered sheet stacking tray 15 and the digital color printer 100 having the delivered sheet stacking tray 15 which realizes a preferable stacking condition of sheets on the delivered sheet stacking surface 15*a* and make it easy to remove the sheets.

Further, in the delivered sheet stacking tray 15 of the present embodiment, the sheet removing concave 15*b* substantially includes and is formed substantially in parallel to a line L1 linking (i) a corner portion of the stacking area of the minimum size sheet which corner portion is positioned on a downstream side in a transporting direction and on a front side of the image forming device to (ii) a corner portion of the stacking area of the maximum size which corner portion is positioned on a downstream side in a transporting direction and on a front side of the image forming device.

Thus, the sheet removing concave 15*b* provided on the delivered sheet stacking surface 15*a* comes nearest to the operator as it extends toward an outside of the digital color printer 100, so that the operator can naturally and easily insert his/her hand from the outside of the digital color printer 100 to the delivered sheet stacking tray 15.

Further, in the delivered sheet stacking tray 15 of the present embodiment, the delivery-roller pair 26*a* of the digital color printer 100 includes the separator 50 which shifts the sheet in a vertical direction with respect to a direction in which the sheet is delivered so as to sort the sheet.

Thus, it is necessary to easily remove the sheets stacked on the delivered sheet stacking surface 15*a* when the sheets are shifted to a back side of the digital color printer 100.

From this view point, in the present embodiment, the sheet removing concave 15*b* is positioned on a back side of a line, or include a line linking (i, iii) a corner portion of a stacking area of a sortable minimum size sheet which corner portion is positioned on a downstream side in a transporting direction and on a front side of the image forming device to (iv) a corner portion of a stacking area of the maximum size sheet which corner portion is positioned on a downstream side in a transporting direction and on a front side of the digital color printer 100 when the sheet is shifted to a back side of the digital color printer 100.

Thus, even though the delivery-roller pair 26*a* includes the separator 50 which shifts the sheet in a vertical direction with respect to a direction in which the sheet is delivered so as to sort the sheet upon delivering the sheet, it is possible to easily remove the sheet stacked on the delivered sheet stacking surface 15*a*.

Further, when sheets sorted into two or three portions, the sorted sheets tend to be disarranged in case of inserting the hand at a right angle with respect to a conventional transporting direction, so that it is necessary to sort the sheets again. In the present embodiment, the operator inserts his/her hand at a substantially right angle with respect to a sorting direction (from a downstream side in a transporting direction) so as to remove the sheets, it is possible to remove the sheets with a preferable sorting condition kept.

Further, in the delivered sheet stacking tray 15 of the present embodiment, the width of the sheet removing concave 15*b* is wider than the width of four fingers excluding a thumb folded on a palm, so that the operator can easily insert his/her hand, without fail, from the outside of the digital color printer 100 to an area where the sheets are stacked.

EMBODIMENT 2

Another embodiment of the present invention is described as follows based on FIG. 7 and FIG. 8. Note that, for convenience in the description, the same reference signs are given to members having the same functions as those of the members shown in the figures which support Example 1, and description thereof is omitted.

Figure 7:
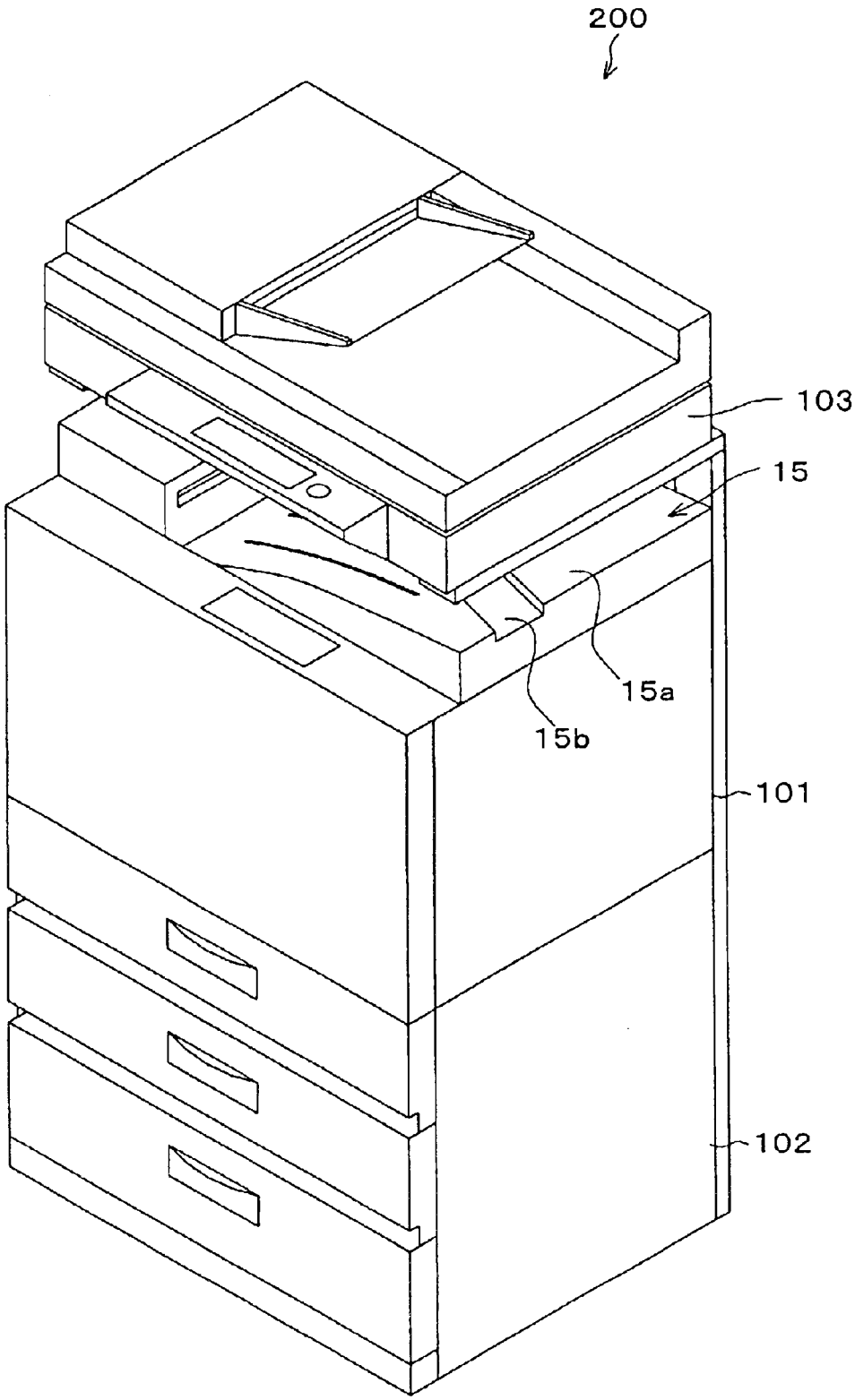
FIG. 7 shows another embodiment of the delivered sheet stacking tray and the image forming device having the delivered sheet stacking tray according to the present invention, and is a perspective view of a digital color copying machine which functions as the image forming device having an image reading device.

In the present embodiment, description is given on a case where the delivered sheet stacking tray 15 described in Example 1 is provided on an upside of the image forming section 101 of a digital color copying machine 200 which functions as the image forming device as shown in FIG. 7.

Figure 8:
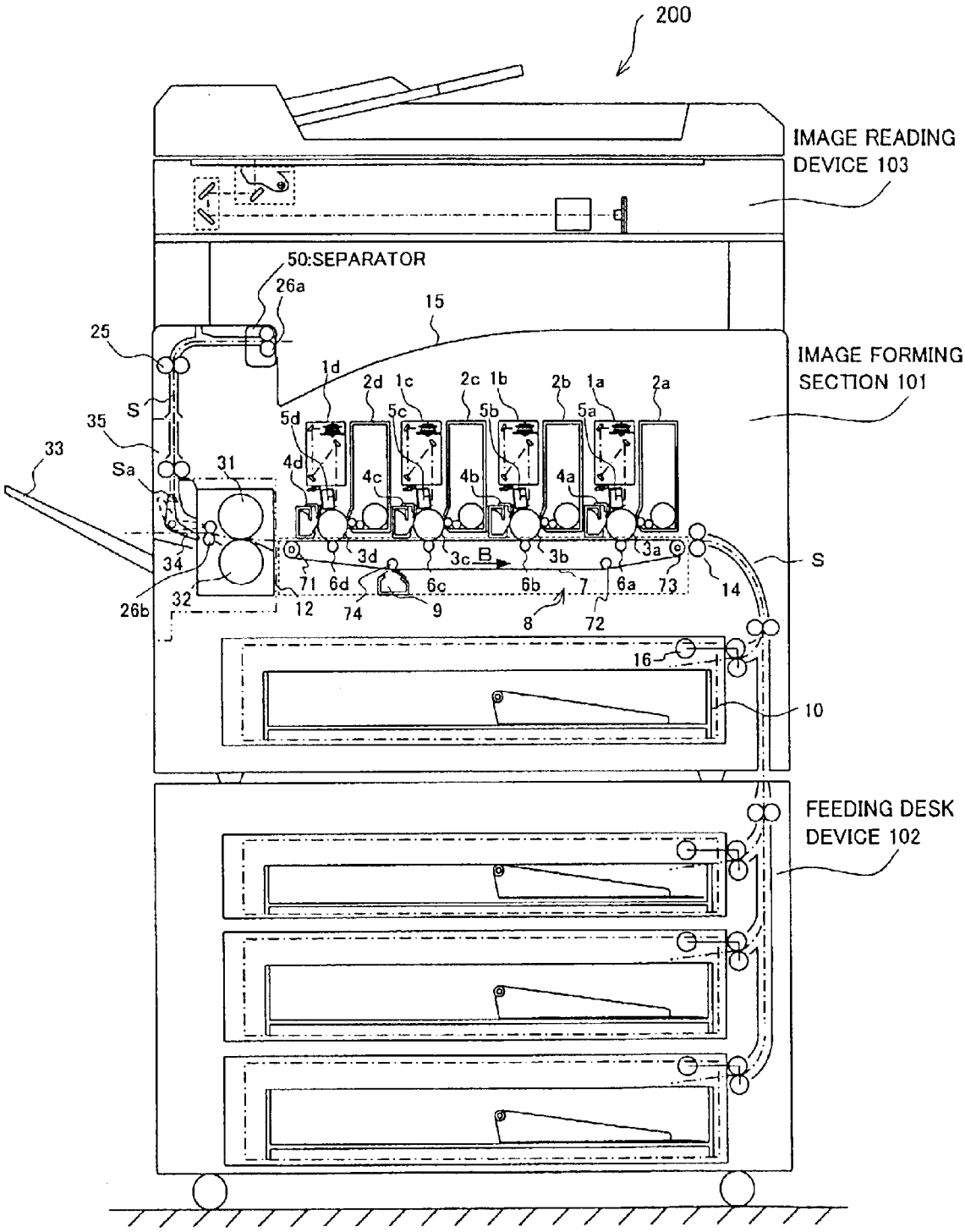
FIG. 8 is a cross sectional view showing an internal structure of the digital color copying machine in a front direction.

That is, as shown in FIG. 7 and FIG. 8, the digital color copying machine 200 of the present embodiment includes: the delivered sheet stacking tray 15, provided on an upside of the image forming section 101, on which sheets delivered from the delivery-roller pair 26*a* functioning as sheet delivering means are stacked; and an image reading device 103, provided above the delivered sheet stacking tray 15 with a space therebetween, which functions as document reading means for converting document image information into an electric signal so as to supply the electric signal to the image forming section 101.

Here, functions of the image forming section 101 and the delivered sheet stacking tray 15 of the digital color copying machine 200 of the present embodiment are the same as those described in Example 1.

Thus, also in the digital color copying machine 200 of the present embodiment, as described above, this arrangement hardly brings about such a problem that: a stacking condition of the sheets on the delivered sheet stacking surface 15*a* is deteriorated, so that it becomes difficult to align the sheets. Further, in order to solve such a problem that it is difficult for the operator to insert his/her hand to the delivered sheet stacking surface 15*a* when the operator performs operations standing near the image forming device, the sheet removing concave 15*b* is formed along the direction in which the sheet is transported, so that the operator can naturally and easily insert his/her hand from the lateral outside of the digital color copying machine 200 to the delivered sheet stacking tray 15.

Note that, in the present embodiment, detail description of the image reading device 103 is omitted since it is not featured in the present invention. Further, the image reading device 103 shown in FIG. 8 has an automatic document carrier, but the arrangement is not limited to this.

In this manner, the digital color copying machine 200 and the delivered sheet stacking tray 15 of the present embodiment are arranged so that the image reading device 103 of the digital color copying machine 200 is provided above the delivered sheet stacking surface 15*a* with a space therebetween.

Thus, even when the image reading device 103 is provided on an upside of the image forming section 101 of the digital color copying machine 200, the delivered sheet stacking surface 15*a* surely supports both sides of the stacked sheet that are parallel to a direction in which sheets ranging from the maximum size sheet to the minimum size sheet are delivered, so that this arrangement does not bring about the following problem: a stacking condition of sheets on the delivered sheet stacking surface 15*a* is deteriorated, so that it is difficult to align the sheets.

Further, in order to solve such a problem that it is difficult for the operator to insert his/her hand to the delivered sheet stacking surface 15*a* when the operator performs operations standing near the image forming device, the sheet removing concave 15*b* is formed along the direction in which the sheet is transported, so that the operator can naturally and easily insert his/her hand from the lateral outside of the digital color copying machine 200 to the area where the sheets are stacked.

As a result, it is possible to provide the delivered sheet stacking tray 15 and the digital color copying machine 200 having the delivered sheet stacking tray 15 which realize a preferable stacking condition of sheets on the delivered sheet stacking surface 15*a* and make it easy to remove the sheets.

EMBODIMENT 3

Another embodiment of the present invention is described as follows based on FIG. 3 and FIG. 9 to FIG. 17. Note that, for convenience in the description, the same reference signs are given to members having the same functions as those of the members shown in the figures which support Example 1 and Example 2, and description thereof is omitted.

Figure 10:
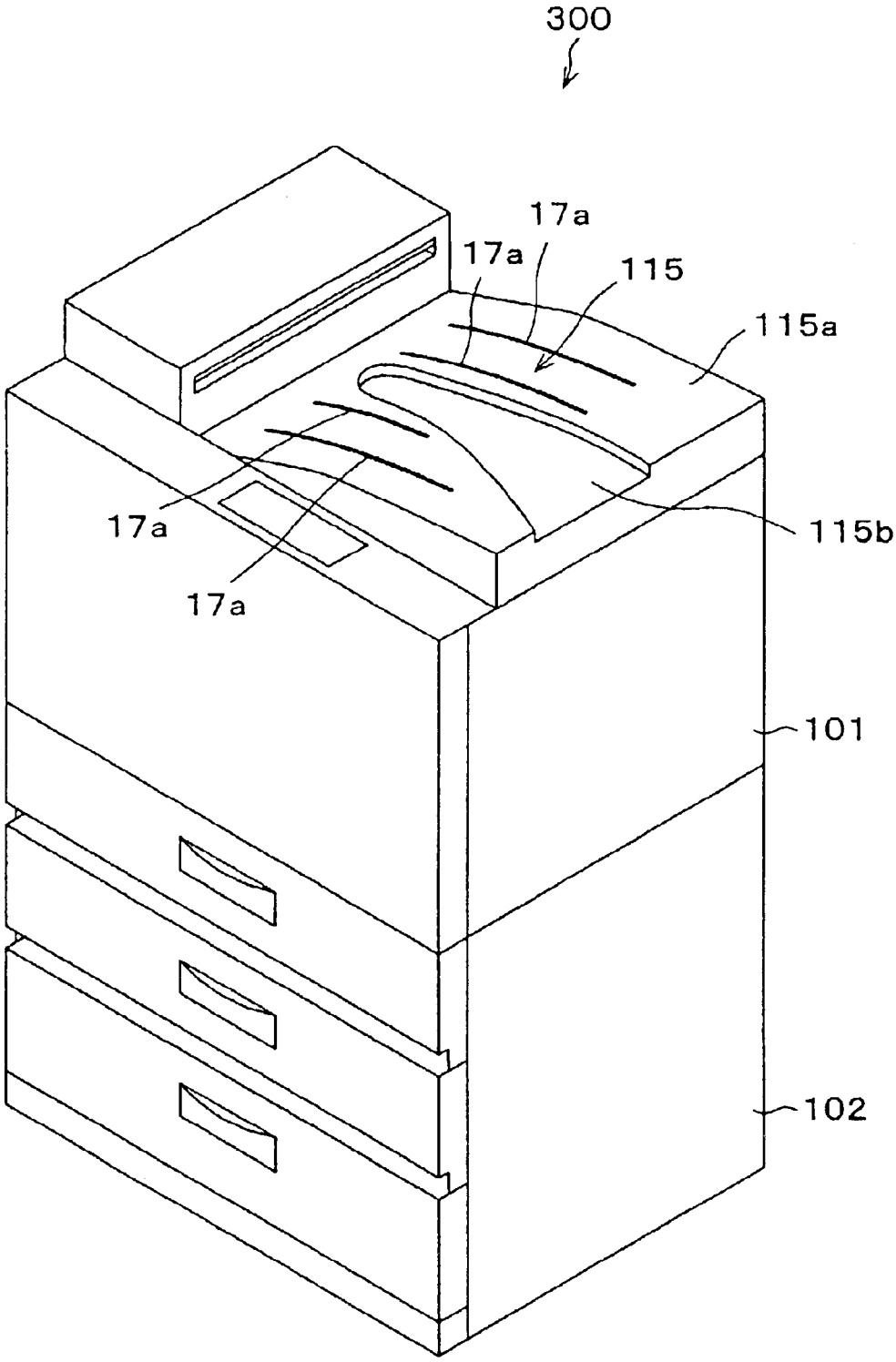
FIG. 10 is a perspective view of a digital color printer which functions as the image forming device.

As shown in FIG. 10, a digital color printer 300 which functions as the image forming device of the present embodiment includes the image forming section 101 which functions as the image forming means and the feeding desk device 102 provided below the image forming section 101. Functions of the image forming section 101 and the feeding desk device 102 in the digital color printer 300 of the present embodiment are the same as those described in Embodiment 1. The digital color printer 300 is different from the digital color printer 100 in that a delivered sheet stacking tray 115 is provided on an upside of the image forming section 101 instead of the delivered sheet stacking tray 15.

The delivered sheet stacking tray 115 of the digital color printer 300 is detailed as follows.

Figure 9:
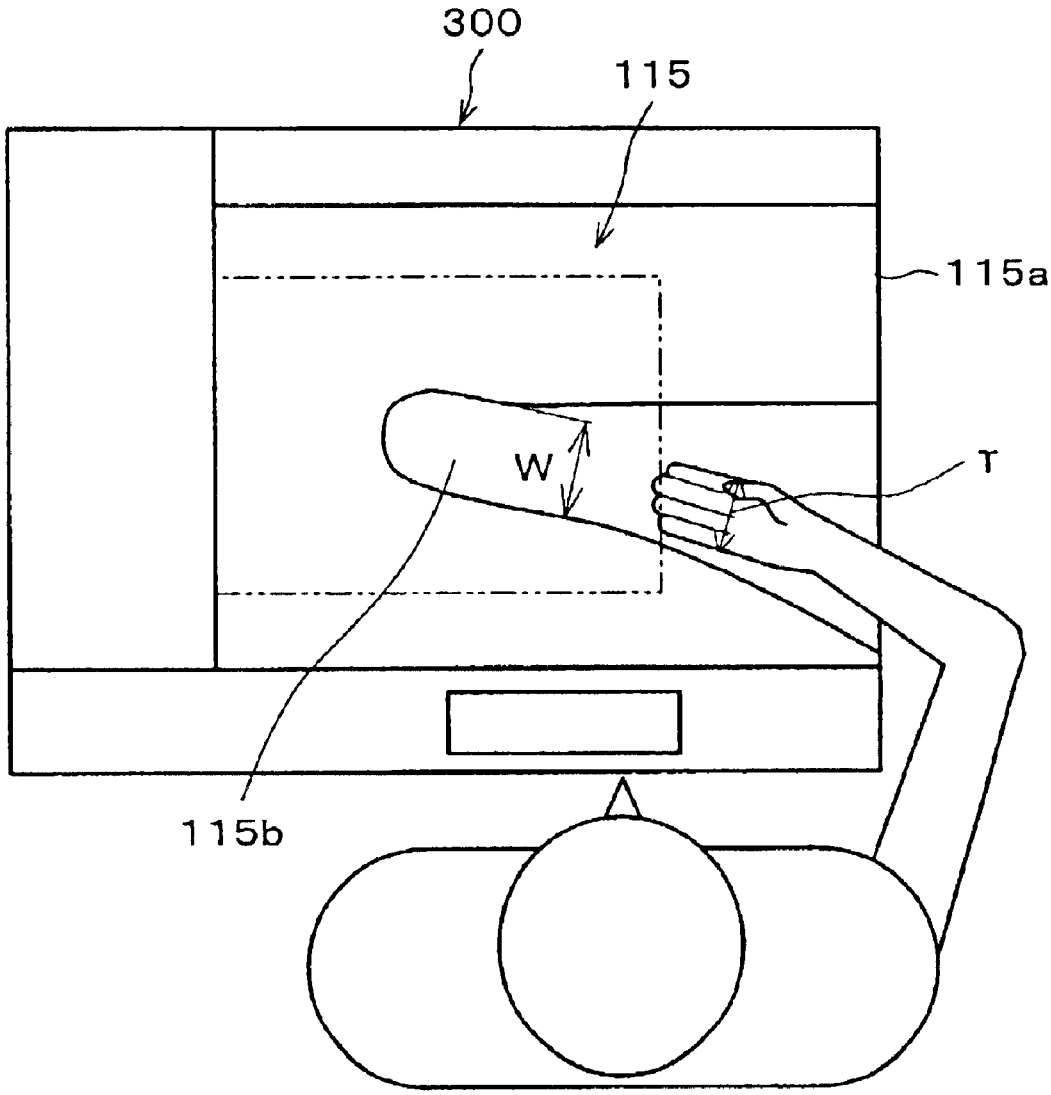
FIG. 9 shows another embodiment of the delivered sheet stacking tray and the image forming device having the delivered sheet stacking tray according to the present invention, and is a plan view showing a condition under which the operator puts his/her hand along the sheet removing concave to the delivered sheet stacking surface.

As shown in FIG. 9, the delivered sheet stacking tray 115 of the present embodiment includes: a delivered sheet stacking surface 115*a* which extends along a direction in which the sheet is transported; and a sheet removing concave 115*b* which functions as a third sheet removing concave positioned lower than the delivered sheet stacking surface 115*a*.

As shown in FIG. 3, in the delivered sheet stacking surface 115*a*, a portion positioned vertically downward with respect to the delivery-roller pair 26*a* is lower than other portion of the delivered sheet stacking surface 115*a* so that some amounts (400 to 500 sheets) of delivered sheets that have free-fallen can be stacked, and a position of the delivered sheet stacking surface 115*a* becomes higher as further from the delivery-roller pair 26*a*.

This arrangement is made so that: the sheets which have been delivered from the delivery-roller pair 26*a* slide along a slant of the delivered sheet stacking surface 115*a*, and a side wall of the delivered sheet stacking tray 115 which is positioned on the side of the delivery-roller pair 26*a* enables the sheets to be uniformly stacked, thereby making it easy to align the plural sheets.

Here, a depth of the sheet removing concave 115*b* shown in FIG. 10 is substantially as long as a thickness of a finger so that it is easy to remove the sheets stacked on the sheet stacking surface 115*a*, and is approximately 11 mm for example in the present embodiment. Note that, the depth of the sheet removing concave 115*b* is not limited to this, but is determined so that it is easy for the operator to insert his/her fingers under the sheets.

Further, as shown in FIG. 9, a width (W) of the sheet removing concave 115*b* is a bit wider than a width (T) of four fingers excluding a thumb folded on a palm, and is approximately 90 mm for example in the present embodiment. Note that, the width (W) of the sheet removing concave 115*b* is not limited to this, but is determined so that it is easy for the operator to insert his/her fingers under the sheets. Thus, it is easy for the operator to insert his/her hand from the outside of the digital color printer 100 to the delivered sheet stacking tray 115.

Further, the sheet removing concave 115*b* is formed on the delivered sheet stacking surface 115*a* so that: when the sheets are delivered, both sides of any size sheet that are in parallel to a delivering direction do not positioned in any concave, and the sheet stacking surface 15*a* surely supports the both sides. Thus, a stacking condition of sheets on the delivered sheet stacking surface 115*a* is preferable and it is easy to align the sheets.

Further, the width (W) of the sheet removing concave 115*b* is wider as it extends toward a downstream side in a transporting direction. Thus, it is possible to easily remove sheets ranging from a small size sheet to a maximum size sheet. Note that, the width (W) of the sheet removing concave 115*b* is a width in a vertical direction with respect to the transporting direction.

Further, in order to reduce contact resistance between the delivered sheet stacking surface 115*a* and the sheet, it is preferable that a rib 17*a* which protrudes a bit from the delivered sheet stacking surface 115*a* is provided on the delivered sheet stacking surface 115*a* (see FIG. 10).

Figure 11:
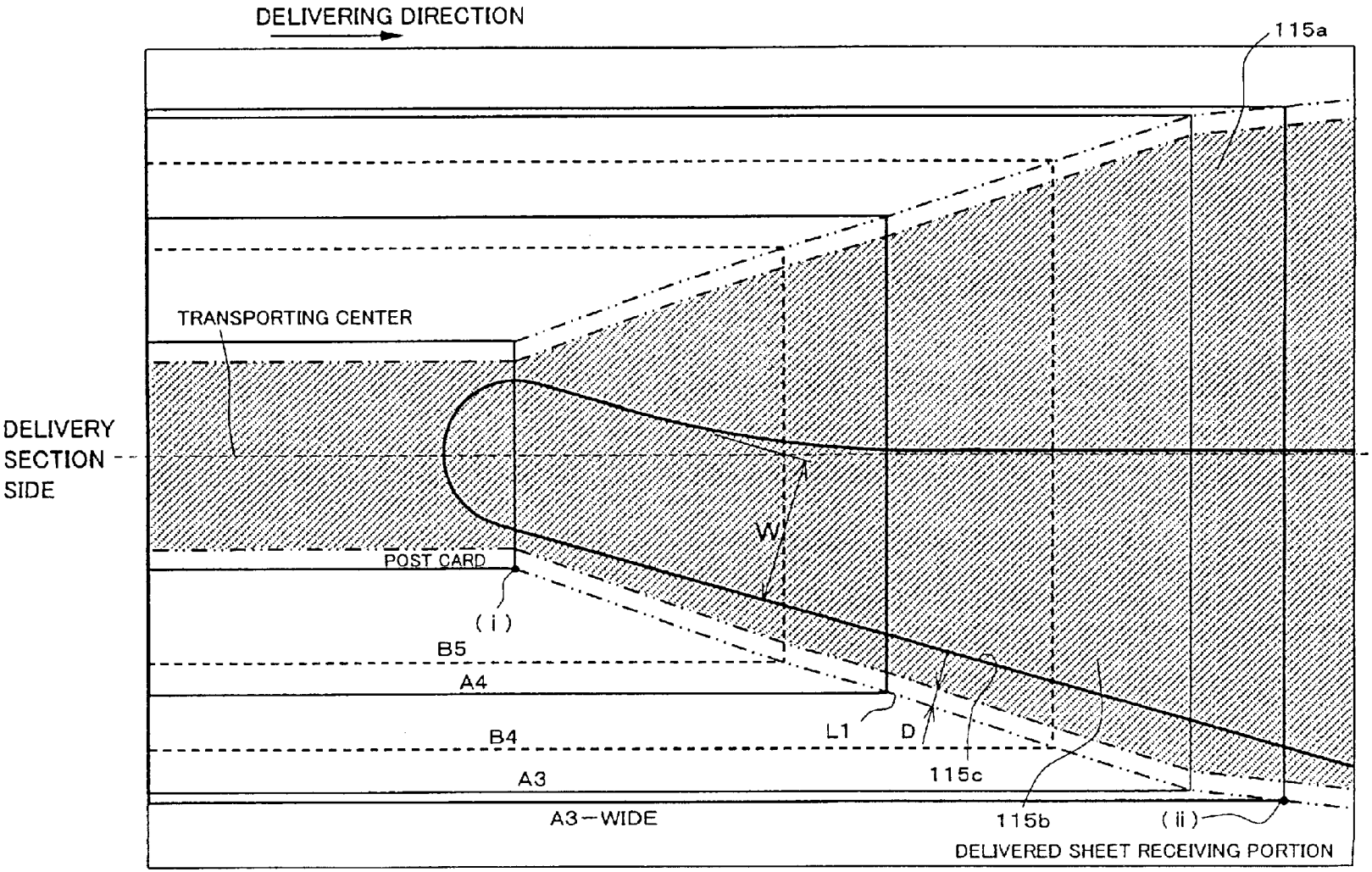
FIG. 11 is a plan view of the sheet removing concave provided on the delivered sheet stacking surface with various sizes of delivered sheets taken into consideration.

Further, as shown in FIG. 11, the delivered sheet stacking tray 115 of the present embodiment is formed so that an edge 115*c* of the sheet removing concave 115*b* which edge 115*c* is positioned on an operation side of the digital color printer 300 approaches the operation side as the sheet removing concave 115*b* extends from an upstream side to a downstream side in the transporting direction.

Thus, a portion through which the operator inserts his/her hand into the sheet removing concave 115*b* provided on the delivered sheet stacking surface 115*a* is positioned nearest to the operator standing on an operation side of the digital color printer 300, so that the operator can naturally and easily insert his/her hand from the lateral outside of the digital color printer 300 to an area where the sheets are stacked. Thus, it is possible to easily remove the sheets.

Note that, in FIG. 11, the minimum size of sheet is described as a post-card size (vertically transported), and the maximum size sheet is described as an A3-wide size sheet, and middle sizes therebetween are described as B5, A4, B4, and A3, but the arrangement is not limited to this. For example, in U.S., an invoice size, a letter size, a regal size, a leisure size, and the like are used, so that a shape and a position of the sheet removing concave 115*b* of the delivered sheet stacking tray 115 may be manufactured according to such sheet sizes. The delivered sheet stacking tray 115 of the present embodiment is such that: when A size and B size sheets are vertically transported, a width of the sheet is narrowest, so that the shape and the position of the sheet removing concave 115*b* of the delivered sheet stacking tray 115 are designed considering a case where the A size and B size sheets are vertically transported.

Further, when the sheet is transported in a cross-feeding manner, a sheet width orthogonal to the transporting direction is wider than the sheet width in the transporting direction, so that a condition under which the sheets are stacked is more preferable. Thus, description thereof is omitted.

The edge 115*c* of the sheet removing concave 115*b* that is positioned on the operation side of the digital color printer 300 is formed on the delivered sheet stacking surface 115*a* so as to approach the operation side of the digital color printer 300 as the sheet removing concave 115*b* extends from (i) a portion that is positioned in a central part of a transport line and inside an end of a minimum size sheet such as a post card size sheet to (ii) an outside of an end of a maximum size sheet such as an A3-wide sheet. Thus, it is easy for the operator to insert his/her hand from an outside of the digital color printer 300 to the delivered sheet stacking tray 115.

Further, as shown in FIG. 11, the sheet removing concave 115*b* is formed substantially in parallel to a line L1 linking (i) an operation-side end corner, regarded as a corner portion of a minimum size sheet, which is positioned in a central part of a transport line and inside an end of the minimum size sheet such as a post card size sheet to (ii) an operation-side end corner which is regarded as a corner portion of the maximum size sheet such as an A3-wide sheet. That is, as shown by a shaded area in FIG. 11, there is a distance D to the line L1 so as to cover (a) the uneven transportation of the sheets deviating in a vertical direction with respect to a direction in which the sheet is transported and (b) unevenness in the sheet sizes.

It may be preferable that a size of the distance D is not less than approximately 5 mm. Thus, the sheet removing concave 115*b* on the delivered sheet stacking surface 115*a* comes nearest to the operator as the sheet removing concave 115*b* extends toward the outside of the digital color printer 300, so that the operator can naturally and easily insert his/her hand from the outside of the digital color printer 300 to the delivered sheet stacking tray 115.

Figure 13:
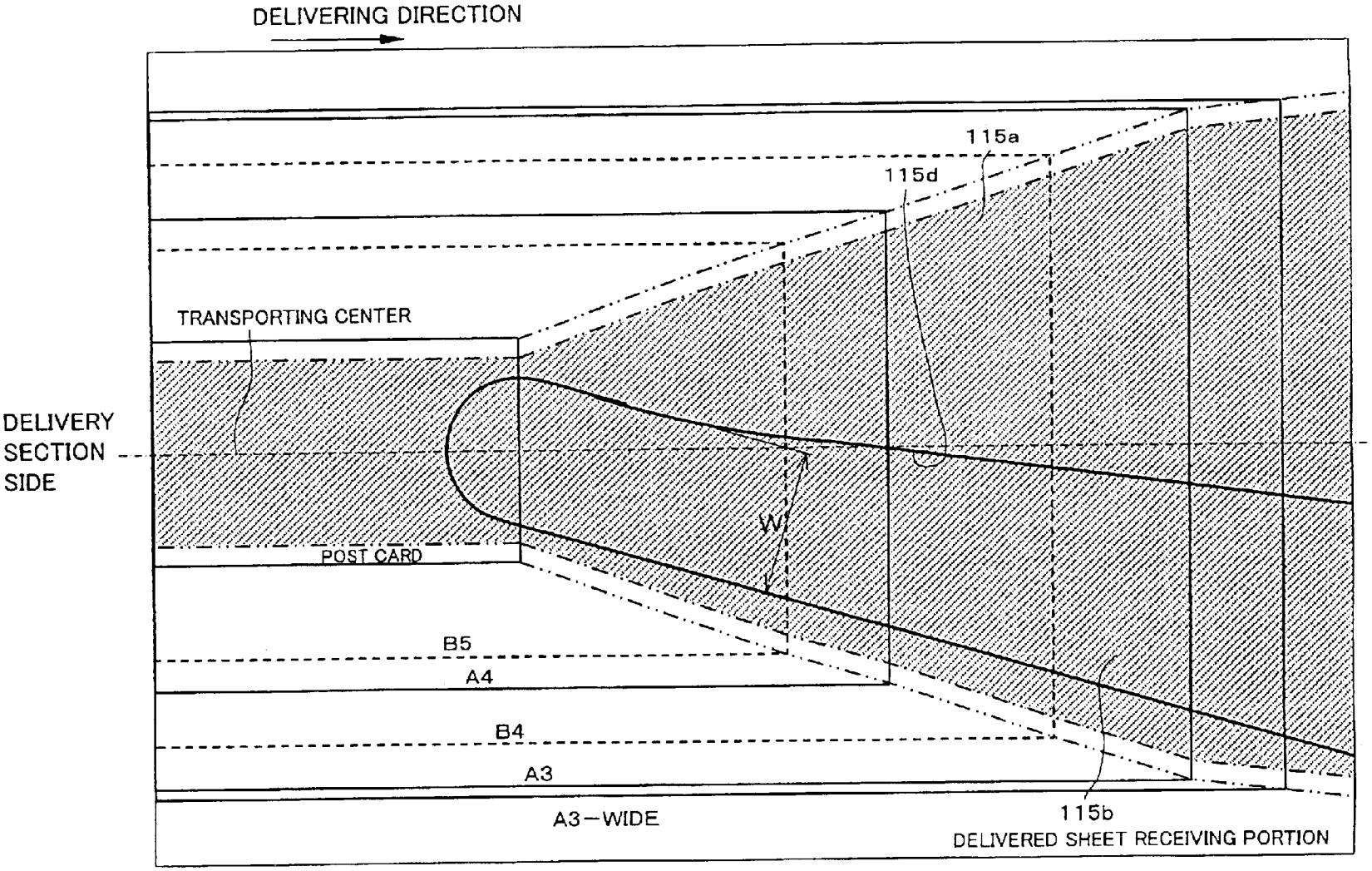
FIG. 13 is a plan view showing a sheet removing concave provided on a delivered sheet stacking surface whose sheet supporting area is made wider in terms of various sizes of delivered sheets.

Further, as shown in FIG. 13, the delivered sheet stacking tray 115 of the present embodiment is formed so that an edge 115*d* of the sheet removing concave 115*b* which edge 115*d* is positioned further from an operation side of the digital color printer 300 approaches the operation side of the digital color printer 300 as the sheet removing concave 115*b* extends from a downstream side of a stacking area of the minimum size sheet such as a post-card-size sheet in the transporting direction to an upstream side of a stacking area of the maximum size sheet such as an A3-wide sheet in the transporting direction.

Note that, the edge 115*d* of the sheet removing concave 115*b* which edge 115*d* is positioned further from the operation side of the digital color printer 300 approaches the operation side of the digital color printer 300 as the sheet removing concave 115*b* extends from an upstream side to a downstream side in the transporting direction under condition that a width (W) of the sheet removing concave 115*b* becomes wider as the sheet removing concave 115*b* extends from a stacking area of a minimum size sheet to the downstream side in the transporting direction.

Thus, the delivered sheet stacking surface 115 supports a wider area of the sheet that is positioned further from the operation side of the digital color printer 300, so that it is possible to prevent the sheet from drooping to the sheet removing concave 115*b*. As a result, it is possible to realize a preferable stacking condition of sheets.

Figure 14:
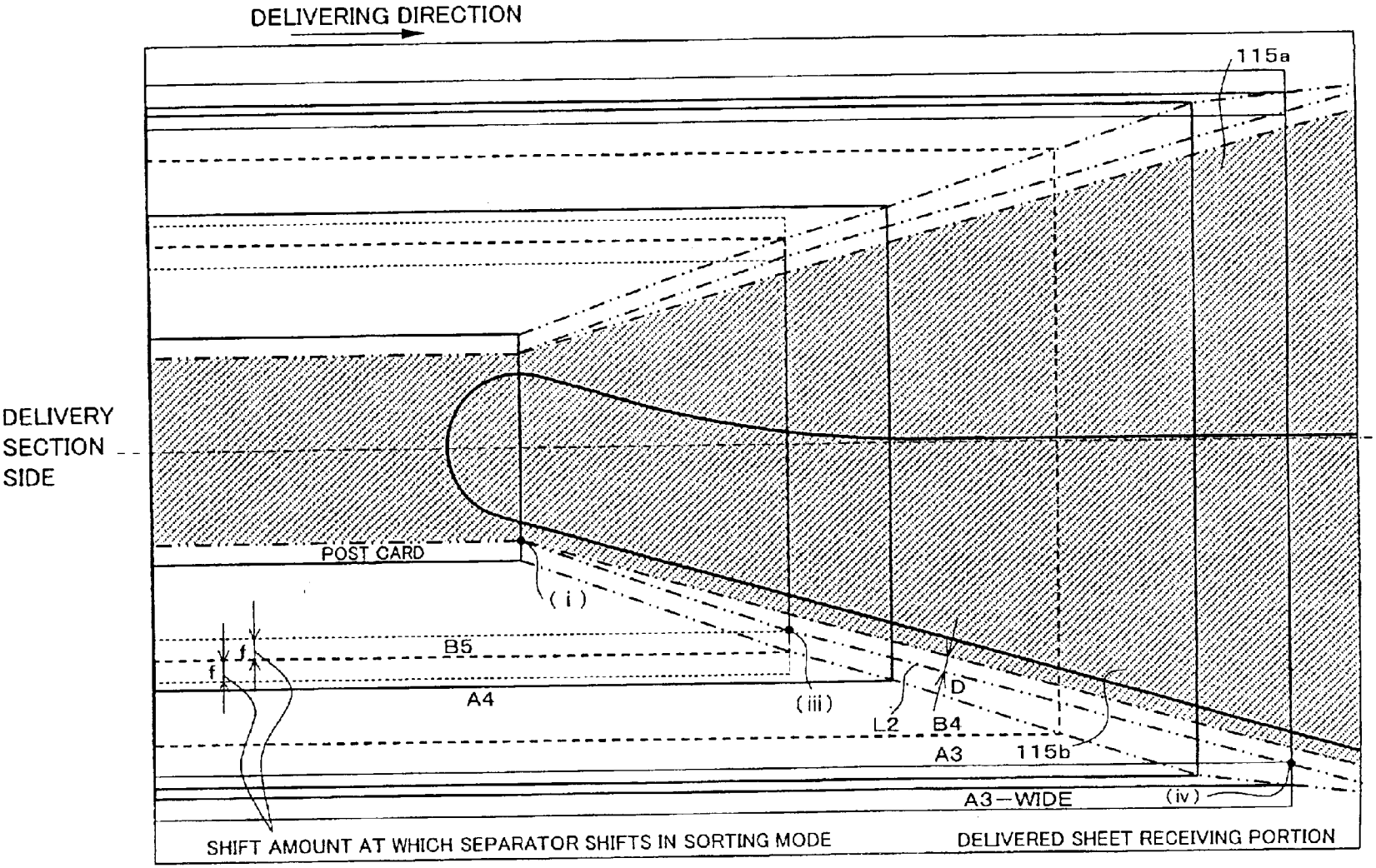
FIG. 14 is a plan view of a sheet removing concave in a case where a separator for sorting the sheets is provided, and the sheet removing concave is provided on the delivered sheet stacking surface with it various sizes of delivered sheets taken into consideration.

Further, when the delivery-roller pair 26*a* has the separator 50 and has a sorting function for shifting a delivered sheet in a vertical direction with respect to a direction in which the sheet is delivered, as shown in FIG. 14, the sheet removing concave 115*b* is formed inside a line L2. The line L2 is formed by linking (i) an operation-side end corner, regarded as a corner portion of a minimum size sheet, which positioned in a central part of a transport line and inside an end of the minimum size sheet such as a post card size sheet via (iii) an operation-side end corner which is regarded as a corner portion of at least the minimum size sheet such as B5-vertical size sheet which is sortable upon shifting the sheet away from the operation side to (iv) an operation-side end corner which is regarded as a corner portion of the maximum size sheet such as an A3-wide sheet. That is, as shown by a shaded area in FIG. 14, there is a distance D to the line L2 so as to cover (a) the uneven transportation of the sheets deviating in a vertical direction with respect to a direction in which the sheet is transported and (b) unevenness in the sheet sizes.

Thus, even when the delivery-roller pair 26*a* has the sorting function for shifting the sheet in a vertical direction with respect to a delivering direction upon delivering the sheet, the operator can easily insert his/her hand from the outside of the digital color printer 300 to the sheet stacking section.

Figure 12:
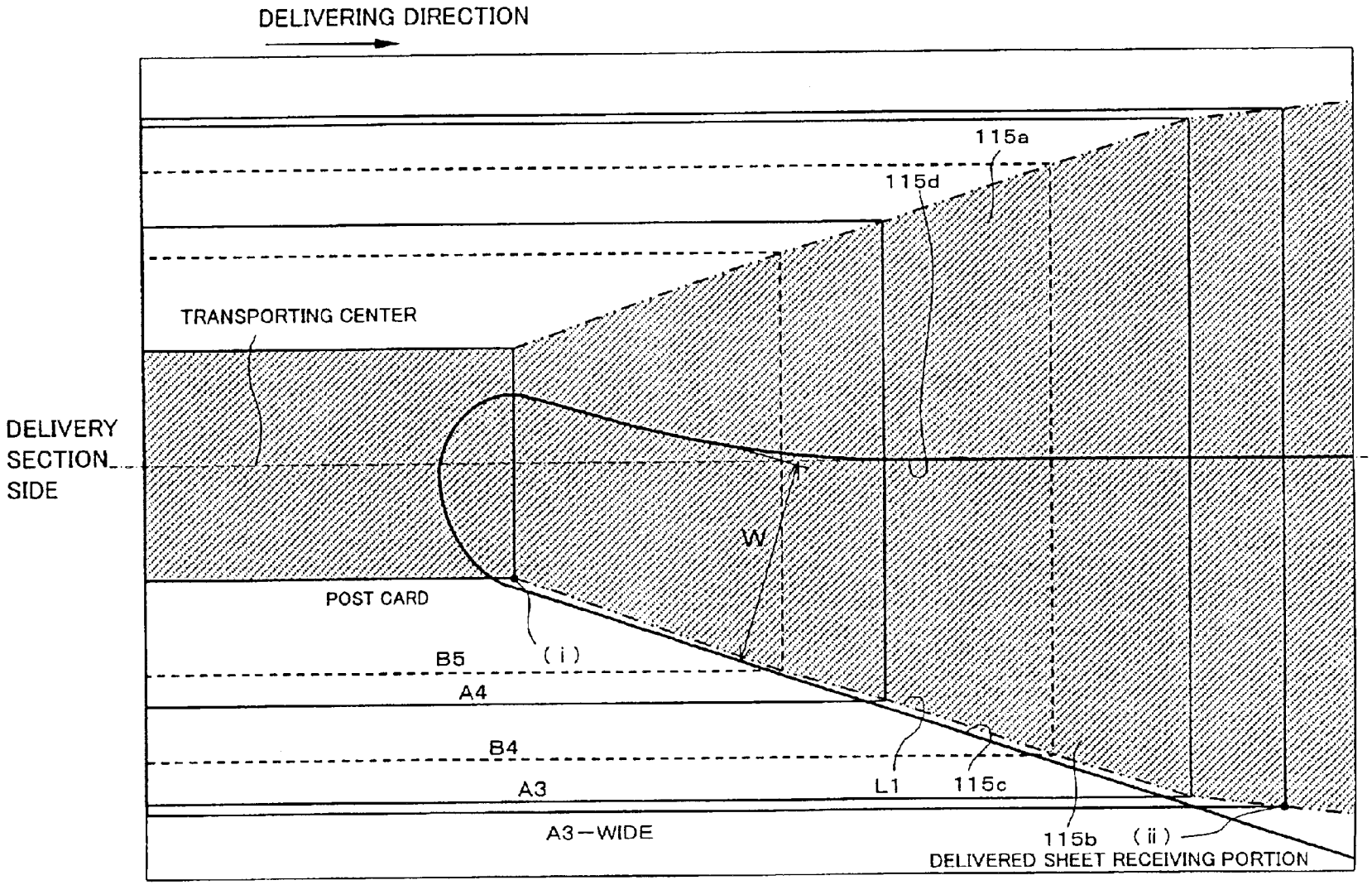
FIG. 12 shows a modification example of the delivered sheet stacking tray and the image forming device having the delivered sheet stacking tray, and is a plan view showing an example of a case where the sheet removing concave includes a line L1.

Note that, in the present embodiment, the sheet removing concave 115*b* is formed within an area ranging from a stacking area of the minimum size sheet to a stacking area of the maximum size sheet. However, the arrangement is not limited to this, but as shown in FIG. 12, it may be so arranged that: the sheet removing concave 115*b* which functions as a four sheet removing concave on the delivered sheet stacking surface 115*a* includes a line linking (ii) a corner portion of a stacking area of the maximum size sheet which corner portion is positioned on a downstream side in a transporting direction and on a front side of the image forming device to (i) a corner portion of a stacking area of the minimum size sheet which corner portion is positioned on the downstream side in the transporting direction and on the front side of the image forming device, and the sheet removing concave 115*b* extends from a transporting-direction end of the delivered sheet stacking surface.

Thus, at least one side of the delivered sheet in the delivering direction is supported by the delivered sheet stacking surface 115*a*, so that it is possible to obtain a similar effect.

Note that, in the foregoing description, the B5-vertical size sheet is used as at least the sortable minimum size sheet, but the arrangement is not limited to this. For example, a post card size sheet may be used.

Note that, a sorting mode for shifting the sheet in a vertical direction with respect to a delivering direction so as to sort the sheet is to vary a position in which the sheet is delivered so as to output the sheet to the delivered sheet stacking tray 115, and is set by an operation section or an external device such as a PC connected via a network. In the sorting mode, upon outputting the sheet to the delivered sheet stacking tray 115, the separator 50 is shifted in a vertical direction with respect to the transporting direction, with the sheet sandwiched by the separator 50, so as to vary the position in which the sheet is delivered, thereby sorting the sheet.

In the present embodiment, the shift to the sorting mode is performed as follows: the sheets are shifted from an ordinary delivering position to both sides at a predetermined amount, so that the sheets are delivered from any one of three delivering positions, i.e., the ordinary delivering position, right and left delivering positions, but the arrangement is not limited to this. For example, the shift of the sorting mode may be performed as follows: the sheets are shifted to two delivering positions, i.e., the ordinary delivering position and a delivering position in which the sheets are shifted in a predetermined direction at a predetermined amount. Further, a shift amount f in the sorting mode of the present embodiment is set to 115 mm, but the arrangement is not limited to this.

Further, as shown in FIG. 10, the delivered sheet stacking tray 115 of the present embodiment is such that: the transporting-direction end of the sheet removing concave 115*b* is opened toward a lateral outside of the digital color printer 300.

Thus, the operator can naturally and easily insert his/her hand from the lateral outside of the digital color printer 300 to an area where the sheets are stacked. Further, even when an image reading device is provided above the delivered sheet stacking tray for example, it is possible to confirm a position of the sheet removing concave 115*b*, so that it is possible to easily remove the sheets.

Note that, an end of the delivered sheet stacking tray 115 does not have to be opened as long as a fingertip can touch an end of the sheet on a downstream side in the transporting direction.

Figure 15:
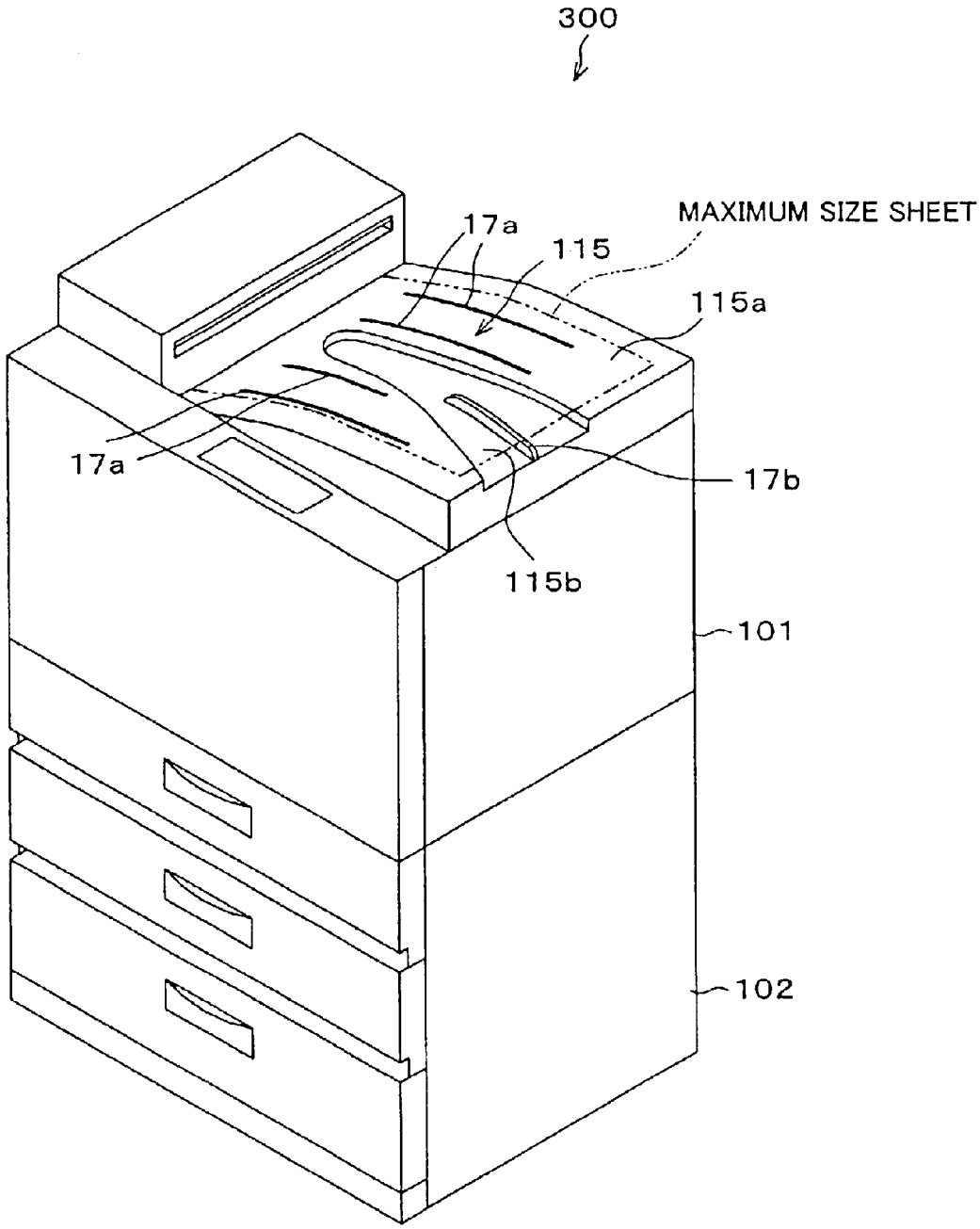
FIG. 15 is a perspective view of the digital color printer functioning as the image forming device, and shows a case where the digital color printer has a sheet droop prevention convex on the sheet removing concave.

Note that, as shown in FIG. 15, the delivered sheet stacking tray 115 of the present embodiment is arranged so that a rib (sheet droop prevention convex) 17*b* is provided on a bottom face of the sheet removing concave 115*b*.

Thus, by providing the rib 17*b* on the bottom face of the sheet removing concave 115*b*, it is possible to prevent a large-size sheet from drooping to the sheet removing concave 115*b* even when the width (W) of the sheet removing concave 115*b* is made wider so as to make it easy for the operator to insert his/her hand. Thus, this hardly brings about the following problems: the sheet droops to the sheet removing concave 115*b*, so that it is difficult to remove the sheet; and a condition under which the sheets are stacked is deteriorated.

Figure 16:
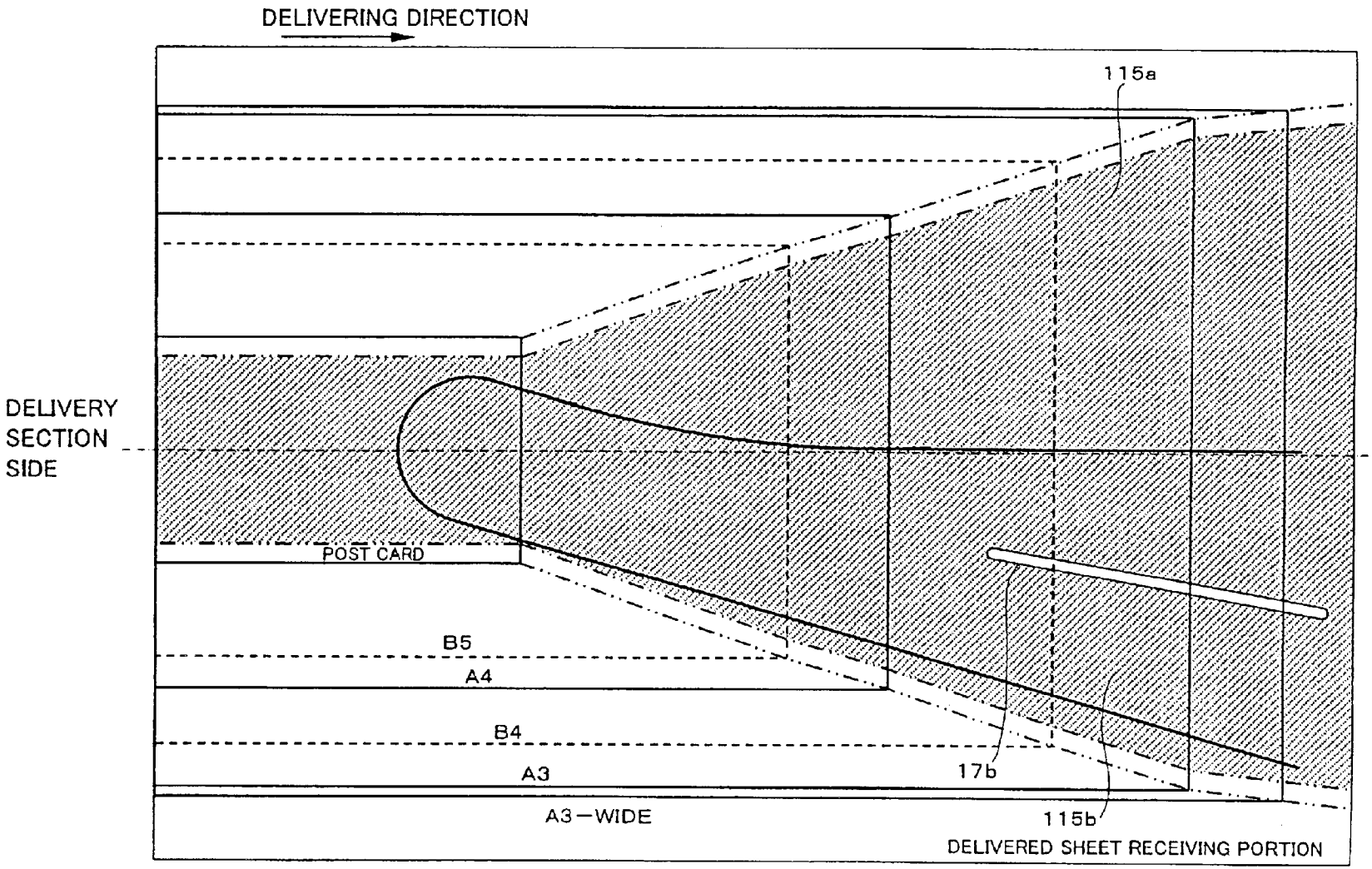
FIG. 16 is a plan view of the sheet removing concave in a case where the sheet droop prevention convex is provided, and the sheet removing concave is provided on the delivered sheet stacking surface with various sizes of delivered sheets taken into consideration.

Further, as shown in FIG. 16, the delivered sheet stacking tray 115 of the present embodiment is arranged so that the rib 17*b* approaches an operation side of the digital color printer 300 as it extends toward the downstream side in the transporting direction.

That is, the rib 17*b* is positioned further from the operation side of the digital color printer 300 as it extends toward a center of a transport line of the minimum size sheet, in the same manner as in movement of the operator's hand inserted to the sheet removing concave 115*b*.

Thus, this arrangement hardly brings about such a problem that: the rib 17*b* prevents the operator from inserting his/her hand to the sheet removing concave 115*b*.

Note that, it is preferable that a top of the rib 17*b* is positioned at the same level as the delivered sheet stacking surface 115*a*, or a height of the rib 17*b* is the same as that of the rib 17*a* provided on the delivered sheet stacking surface 115*a*.

Figure 17:
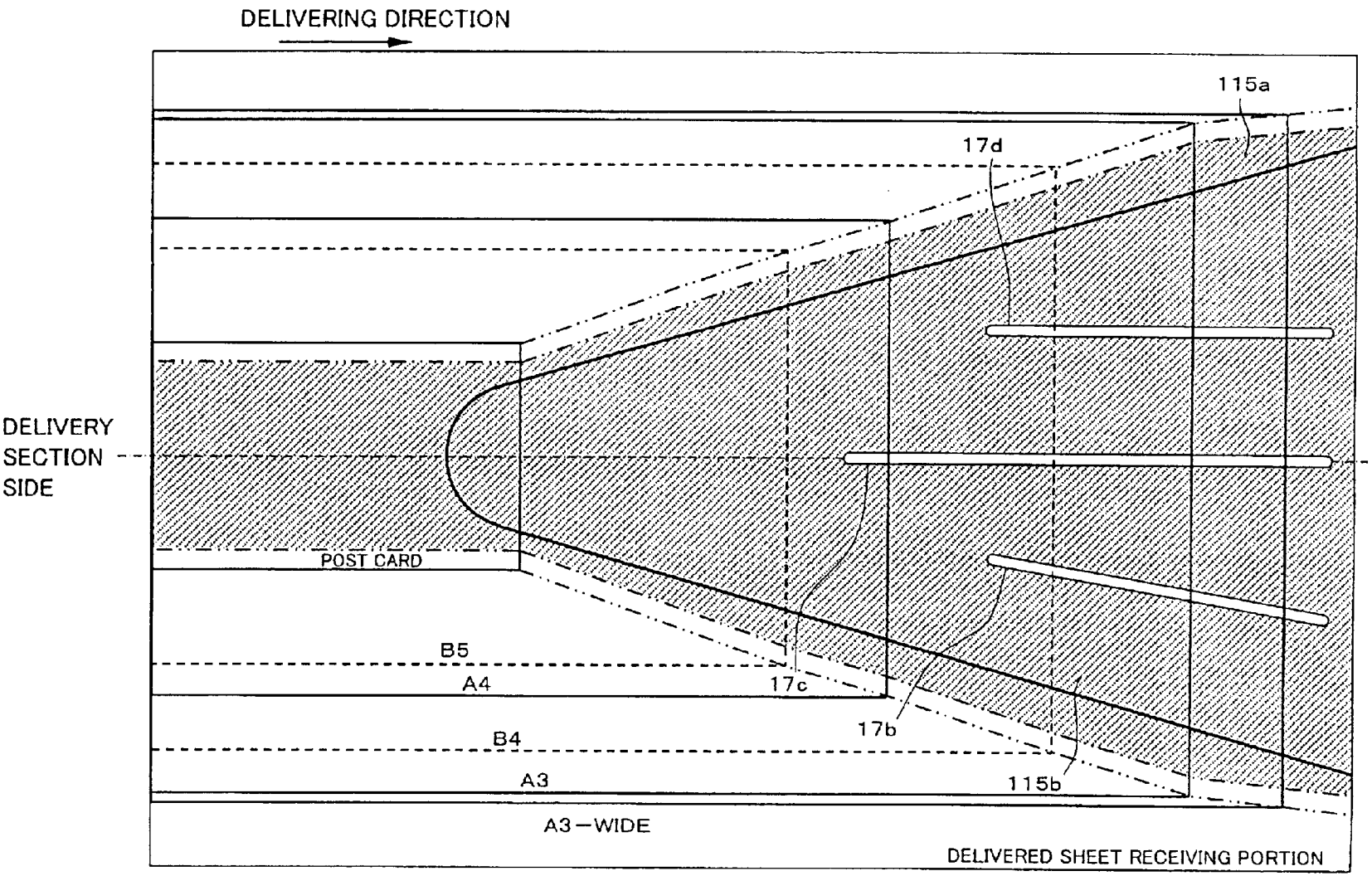
FIG. 17 shows one embodiment in a case where a plurality of sheet droop prevention convexes are provided on the sheet removing concave, and is a plan view showing the sheet removing concave provided on the delivered sheet stacking surface with various sizes of delivered sheets taken into consideration.

Further, as shown in FIG. 17, the delivered sheet stacking tray 115 of the present embodiment is arranged so that ribs 17*b*, 17*c*, 17*d* are provided on the bottom face of the sheet removing concave 115*b*, and the rib 17*b* nearest to the operation side of the digital color printer 300 is formed so as to be approach the operation side of the digital color printer 300 as it extends toward the downstream side in the transporting direction.

Figure 18:
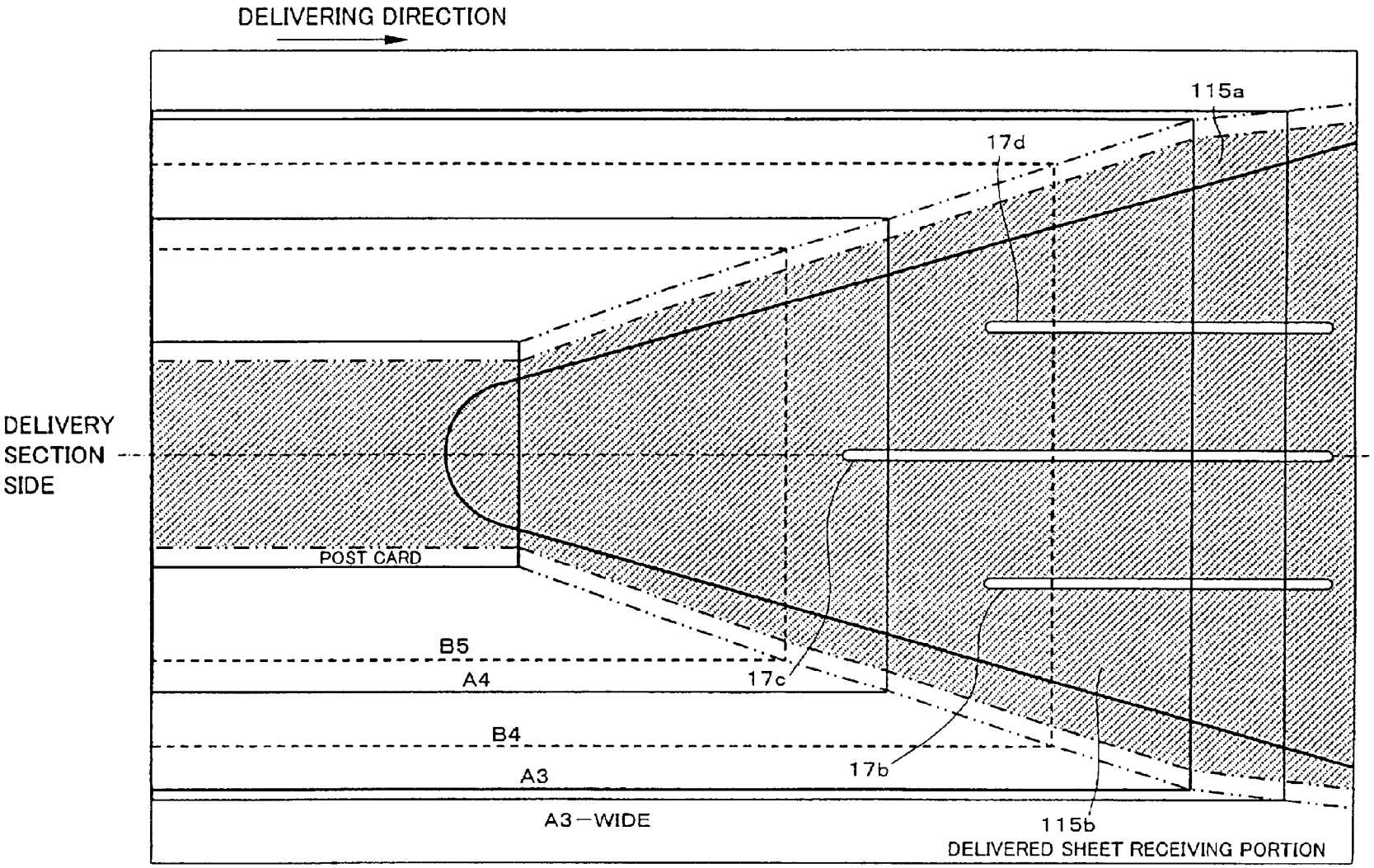
FIG. 18 shows another embodiment in a case where a plurality of sheet droop prevention convexes are provided on the sheet removing concave, and is a plan view showing the sheet removing concave provided on the delivered sheet stacking surface with various sizes of delivered sheets taken into consideration.

Thus, even when the width (W) of the sheet removing concave 115*b* is made wider so that it is easy for the operator to insert his/her hand to the sheet removing concave 115*b*, it is possible to prevent a large-size sheet from drooping to the sheet removing concave 115*b*. Further, as shown in FIG. 18, compared with a case where the rib 17*b* is provided substantially in parallel to the sheet transporting direction, the rib 17*b* does not prevent the operator from inserting his/her hand to the sheet removing concave 115*b*.

Further, the delivered sheet stacking tray 115 of the present embodiment is arranged so that the rib 17*b* is formed on the sheet removing concave 115*b* so as to extend further than an end of the stacking area surface of the maximum size sheet toward the downstream side in the transporting direction.

In a case where the rib 17*b* is positioned under the maximum size sheet, there occurs such a trouble that: when the operator inserts his/her fingers under the sheet, a fingertip touches the rib 17*b*. However, the rib 17*b* extends further than the stacking area surface of the maximum size sheet toward the downstream side in the transporting direction, so that a part of the rib 17*b* protrudes from the maximum size sheet even when the maximum size sheet is stacked. As a result, it is possible to see the rib 17*b*. Thus, it is possible to confirm where the rib 17*b* exists, so that it is possible to prevent the fingertip from touching the rib 17*b* when the operator inserts his/her finger under the sheet.

Further, the delivered sheet stacking tray 115 of the present embodiment is arranged so that the rib 17*b* is positioned lower as it extends from the upstream side to the downstream side in the transporting direction.

Thus, when the operator inserts his/her hand to the sheet removing concave 115*b* so as to remove the sheet, it is possible to prevent the fingertip from touching the rib 17*b*.

Further, in the delivered sheet stacking tray 115 of the present embodiment, a minimum gap between the rib 17*b* and the sheet removing concave 115*b* is wider than a width of a finger, and a minimum gap between sheet droop prevention convexes adjacent to each other is wider than the width of the finger, so that the finger of the operator can pass between the rib 17*b* and an edge of the sheet removing concave 115*b*, and the finger of the operator can pass between the sheet droop prevention convexes adjacent to each other, when the operator inserts his/her hand to the sheet removing concave 115*b* so as to remove the sheet. Thus, it is possible to easily hold the sheet, and it is possible to prevent the fingertip from touching the rib 17*b*.

Further, in the present embodiment, the polychromatic image forming device is described, but a single image forming station may be provided.

Further, the feeding desk device 102 is not featured in the present invention, so that description thereof is omitted. Note that, in the present embodiment, as shown in FIG. 3, the feeding desk device 102 has three feeding trays, but the arrangement is not limited to this. A single feeding tray, two feeding trays provided in parallel to each other as tandem trays, a feeding desk which functions merely as a desk, and the like can be installed as required by a user.

In this manner, in the digital color printer 300 and the delivered sheet stacking tray 115 of the present embodiment, the delivered sheet stacking surface 115*a* includes the sheet removing concave 115*b* which extends from (a) the transporting-direction end of the delivered sheet stacking surface 115*a* via (b) the stacking area of the maximum size sheet to (c) the stacking area of the minimum size sheet, and the width (W) of the sheet removing concave 115*b* is wider as it extends toward the downstream side in the transporting direction.

Thus, the delivered sheet stacking surface 115*a* includes the sheet removing concave 115*b* positioned in a part of a direction in which the sheet is transported, but the sheet removing concave 115*b* is formed along the direction in which the sheet is transported.

Further, the sheet removing concave 115*b* is formed within the stacking area surface which covers sheets ranging from the maximum size sheet to the minimum size sheet for example. Thus, the delivered sheet stacking surface 115*a* surely supports both sides of the stacked sheet that are parallel to a direction in which sheets ranging from the maximum size sheet to the minimum size sheet are delivered, so that this arrangement does not bring about the following problem: a stacking condition of sheets on the delivered sheet stacking surface 115*a* is deteriorated, so that it becomes difficult to align the sheets. Note that, in the present embodiment, the sheet removing concave 115*b* is formed within an area ranging from the stacking area of the minimum size sheet to the stacking area of the maximum size sheet. However, the arrangement is not limited to this, but other arrangement may be made as long as the sheet removing concave 115*b* is positioned within an area ranging from a stacking area of a small size sheet smaller than the maximum size sheet to the stacking area of the maximum size sheet.

Further, in order to solve such a problem that it is difficult for the operator to insert his/her hand to the delivered sheet stacking surface 115*a* when the operator performs operations standing near the image forming device, the sheet removing concave 115*b* is formed along the direction in which the sheet is transported, so that the operator can naturally and easily insert his/her hand from the lateral outside of the digital color printer 300 to the area where the sheets are stacked.

As a result, it is possible to provide the delivered sheet stacking tray 115 and the digital color printer 300 having the delivered sheet stacking tray 115 which realize a preferable stacking condition of sheets on the delivered sheet stacking surface 115*a* and make it easy to remove the sheets.

Further, in the delivered sheet stacking tray 115 and the digital color printer 300 of the present embodiment, an end of the sheet which end is positioned further from the operation side of the digital color printer 300 is supported by the delivered sheet stacking surface 115*a* upon delivering the sheet to the delivered sheet stacking surface 115*a*. While, it is possible to form the sheet removing concave 115*b*, which includes the line L1 linking (ii) a corner portion of a stacking area of the maximum size sheet which corner portion is positioned on a downstream side in a transporting direction and on a front side of the digital color printer 300 to (i) a corner portion of a stacking area of a small size sheet, such as a minimum size sheet, smaller than the maximum size sheet which corner portion is positioned on the downstream side in the transporting direction and the front side of the digital color printer 300 so that it extend from a transporting-direction end of the delivered sheet stacking surface 115*a* and the width (W) of the sheet removing concave 115*b* becomes wider toward the downstream side in the transporting direction.

Thus, the delivered sheet stacking surface 115*a* includes the sheet removing concave 115*b* positioned in a part of a direction in which the sheet is transported, but the sheet removing concave 115*b* is formed along the direction in which the sheet is transported.

Further, the delivered sheet stacking surface 115*a* includes a line L1 linking (ii) a corner portion of a stacking area of the maximum size sheet which corner portion is positioned on a downstream side in a transporting direction and on a front side of the digital color printer 300 to (i) a corner portion of a stacking area of a small size sheet, such as a maximum size sheet, smaller than the maximum size sheet which corner portion is positioned on a downstream side in the transporting direction and on the front side of the digital color printer 300. Thus, the delivered sheet stacking surface 115*a* supports at least one side of the delivered sheet in a direction in which sheets ranging from the maximum size sheet to the minimum size sheet for example are delivered, so that this arrangement does not bring about the following problem: a stacking condition of sheets on the delivered sheet stacking surface 115*a* is deteriorated, so that it becomes difficult to align the sheets.

Further, in order to solve such a problem that it is difficult for the operator to insert his/her hand to the delivered sheet stacking surface 115*a* when the operator performs operations standing near the image forming device, the sheet removing concave 115*b* is formed along the direction in which the sheet is transported, so that the operator can naturally and easily insert his/her hand from the lateral outside of the digital color printer 300 to the area where the sheets are stacked.

As a result, it is possible to provide the delivered sheet stacking tray 115 and the digital color printer 300 having the delivered sheet stacking tray 115 which realize a preferable stacking condition of the sheets on the delivered sheet stacking surface 115*a* and make it easy to remove the sheets.

Further, in the delivered sheet stacking tray 115 of the present embodiment, the sheet removing concave 115*b* is formed substantially in parallel to a line linking (i) a corner portion of a stacking area of a minimum size sheet which corner portion is positioned on a downstream side in a transporting direction and on an operation side of the digital color printer 300 to (ii) a corner portion of a stacking area of a maximum size sheet which corner portion is positioned on the downstream side in the transporting direction and on the operation side of the digital color printer 300.

Thus, the sheet removing concave 115*b* provided on the delivered sheet stacking surface 115*a* approaches the operator standing on the front side of the digital color printer 300 as it extends outward, so that the operator can naturally and easily insert his/her hand from the outside of the side portion of the digital color printer 300 to the area where the sheets are stacked.

Further, in the delivered sheet stacking tray 115 of the present embodiment, the delivery-roller pair 26*a* of the digital color printer 300 includes the separator 50 which shifts the sheet in a vertical direction with respect to a direction in which the sheet is delivered so as to sort the sheet.

Thus, it is necessary to easily remove the sheet stacked on the delivered sheet stacking surface 115*a* when the sheet is shifted to a back side of the digital color printer 300.

From this view point, in the present embodiment, the sheet removing concave 115*b* is formed so as to be positioned on a back side of a line, or include a line linking (i, iii) a corner portion of a stacking area of a sortable minimum size sheet which corner portion is positioned on a downstream side in a transporting direction and on a front side of the image forming device to (iv) a corner portion of a stacking area of a maximum size sheet which corner portion is positioned on the downstream side and on a front side of the digital color printer 300 when the sheet is shifted to a back side of the digital color printer 300.

Thus, even though the delivery-roller pair 26*a* includes the separator 50 which shifts the sheet in a vertical direction with respect to a direction in which the sheet is delivered so as to sort the sheet upon delivering the sheet, it is possible to easily remove the sheet stacked on the delivered sheet stacking surface 115*a*.

Further, when sheets sorted into two or three portions, the sorted sheets tend to be disarranged in case of inserting the hand at a right angle with respect to a conventional transport direction, so that the sheets are unsorted again. In the present embodiment, the operator inserts his/her hand at a substantially right angle with respect to a sorting direction (from a downstream side in the transporting direction) so as to remove the sheets, it is possible to remove the sheets with the sorting condition kept preferable.

EMBODIMENT 4

Another embodiment of the present invention is described as follows based on FIG. 19 and FIG. 20. Note that, for convenience in the description, the same reference signs are given to members having the same functions as those of the members shown in the figures which support Examples 1, 2, and 3, and description thereof is omitted.

Figure 19:
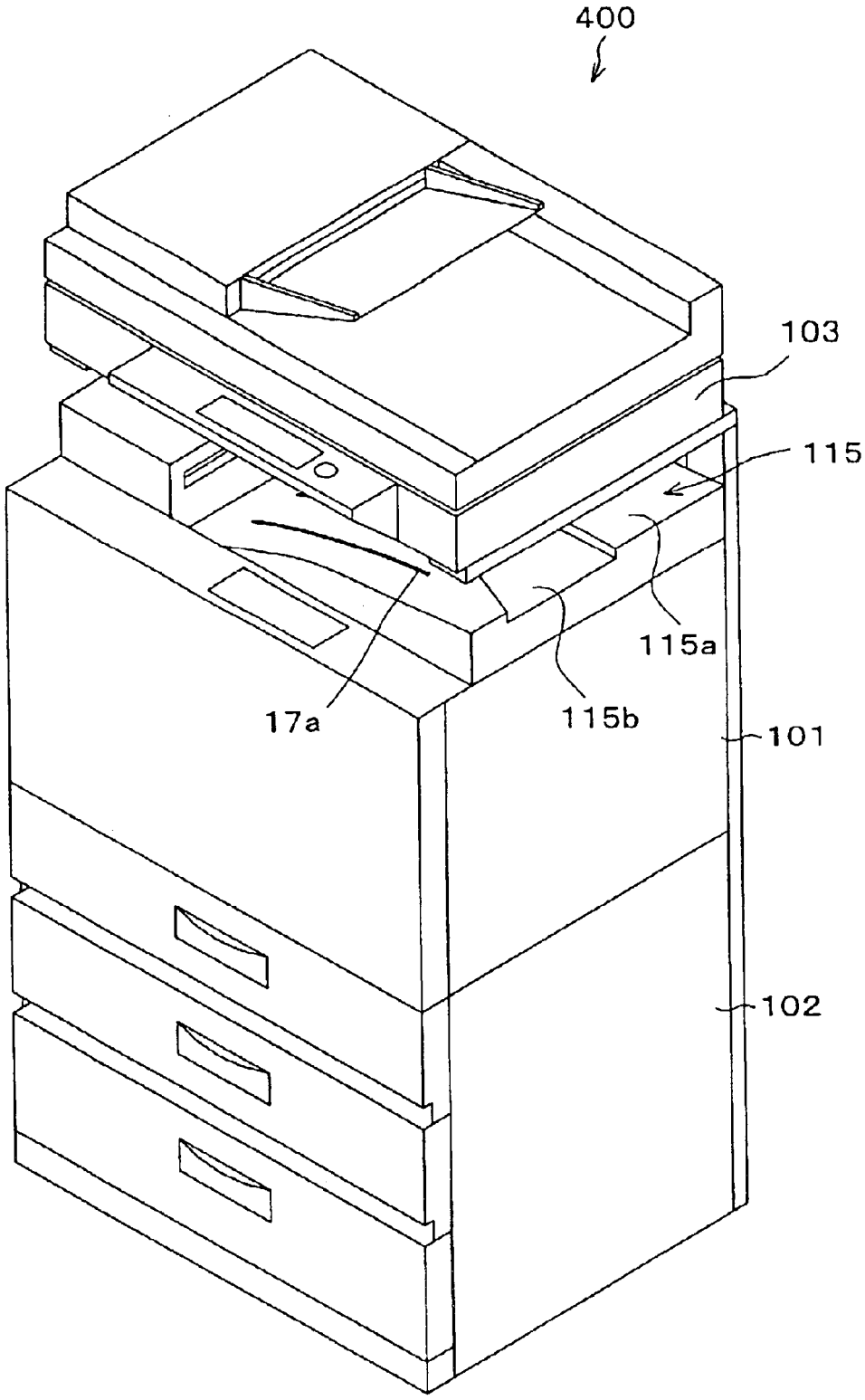
FIG. 19 shows another embodiment of the delivered sheet stacking tray and the image forming device having the delivered sheet stacking tray according to the present invention, and is a perspective view showing a digital color copying machine which functions as the image forming device having an image reading device.

The present embodiment describes a case where a digital color copying machine 400 functioning as the image forming device in which the delivered sheet stacking tray 115 described in Example 3 is provided on an upside of the image forming section 101 as shown in FIG. 19.

Figure 20:
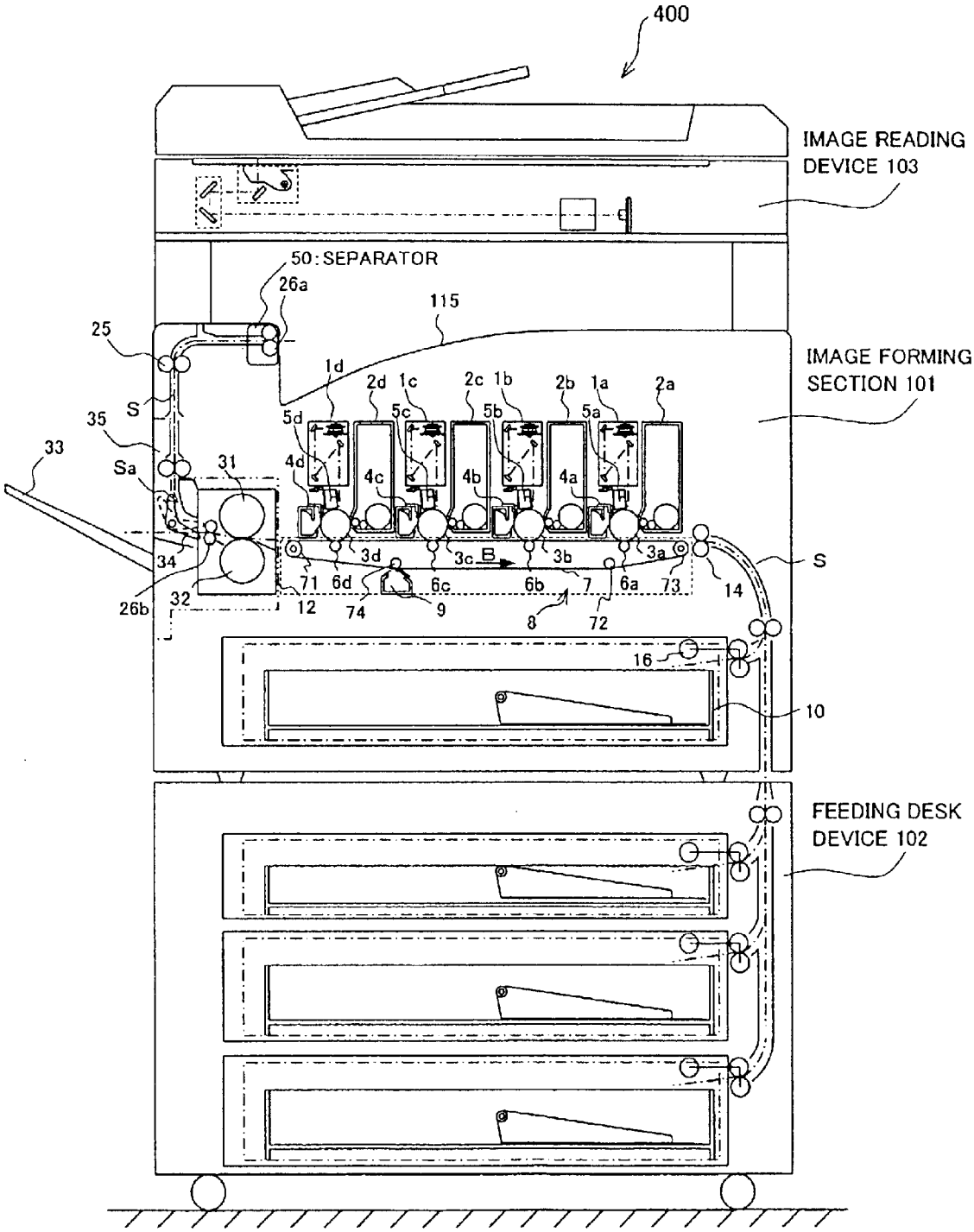
FIG. 20 is a cross sectional view showing an internal structure of the digital color copying machine.
Figure 21:
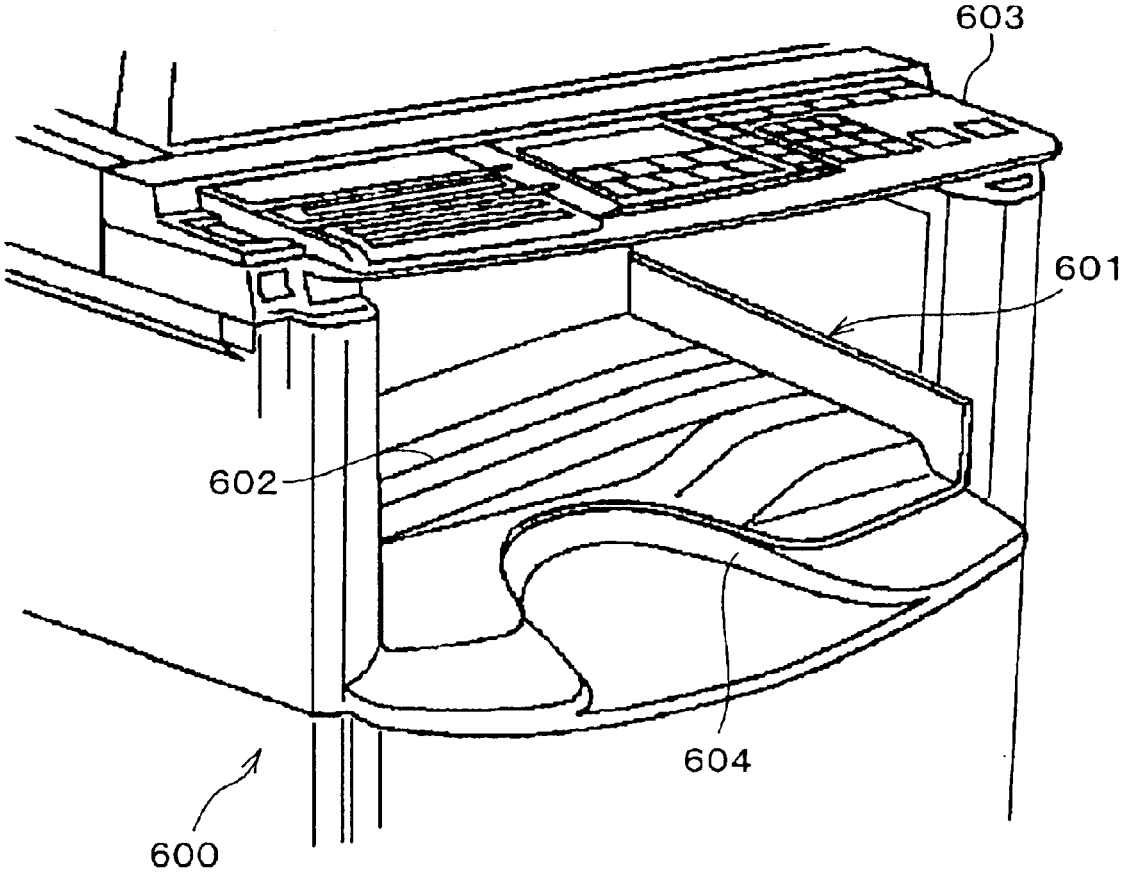
FIG. 21 is a perspective view showing an important portion of a conventional delivered sheet stacking tray and an image forming device having the delivered sheet stacking tray.

That is, as shown in FIG. 19 and FIG. 20, the digital color copying machine 400 of the present embodiment includes: the delivered sheet stacking tray 115, provided on an upside of the image forming section 101, on which sheets delivered from the delivery-roller pair 26*a* functioning as sheet delivering means are stacked; and an image reading device 103, provided above the delivered sheet stacking tray 115 with a space therebetween, which functions as document reading means for converting document image information into an electric signal so as to supply the electric signal to the image forming section 101.

Here, functions of the image forming section 101 and the delivered sheet stacking tray 115 in the digital color copying machine 400 of the present embodiment are the same as those described in Example 3.

Thus, also in the digital color copying machine 400 of the present embodiment, as described above, this arrangement hardly brings about such a problem that: a stacking condition of sheets on the delivered sheet stacking surface 115*a* is deteriorated, so that it becomes difficult to align the sheets. Further, in order to solve such a problem that it is difficult for the operator to insert his/her hand to the delivered sheet stacking surface 115*a* when the operator performs operations standing near the image forming device, the sheet removing concave 115*b* is formed along the direction in which the sheet is transported, so that the operator can naturally and easily insert his/her hand from the lateral outside of the digital color copying machine 400 to the delivered sheet stacking tray 115.

Note that, in the present embodiment, detail description of the image reading device 103 is omitted since it is not featured in the present invention. Further, the image reading device 103 shown in FIG. 20 has an automatic document carrier, but the arrangement is not limited to this.

In this manner, the digital color copying machine 400 and the delivered sheet stacking tray 115 of the present embodiment are arranged so that the image reading device 103 of the digital color copying machine 400 is provided above the delivered sheet stacking surface 115*a* with a space therebetween.

Thus, even when the image reading device 103 is provided on an upside of the image forming section 101 of the digital color copying machine 400, the delivered sheet stacking surface 115*a* surely supports both sides of the stacked sheet that are parallel to a direction in which sheets ranging from the maximum size sheet to the minimum size sheet are delivered, so that this arrangement does not bring about the following problem: a stacking condition of sheets on the delivered sheet stacking surface 115*a* is deteriorated, so that it becomes difficult to align the sheets.

Further, in order to solve such a problem that it is difficult for the operator to insert his/her hand to the delivered sheet stacking surface 115*a* when the operator performs operations standing near the image forming device, the sheet removing concave 115*b* is formed along the direction in which the sheet is transported, so that the operator can naturally and easily insert his/her hand from the lateral outside of the digital color copying machine 400 to the area where the sheets are stacked.

As a result, it is possible to provide the delivered sheet stacking tray 115 and the digital color copying machine 400 having the delivered sheet stacking tray 115 which realize a preferable stacking condition of sheets on the delivered sheet stacking surface 115*a* and make it easy to remove the sheets.

Note that, the present invention is not limited to the aforementioned embodiments, but includes embodiments obtained by combining technical means disclosed in different embodiments with each other as technical means of the present invention.

As described above, the delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: the delivered sheet stacking surface has a sheet removing concave (first sheet removing concave) which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet.

Further, the image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: the delivered sheet stacking surface of the delivered sheet stacking tray has a sheet removing concave (first sheet removing concave) which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet.

According to the arrangement, the delivered sheet stacking surface has the first sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet.

Thus, the delivered sheet stacking surface has the first sheet removing concave which exists in a part of a direction in which the delivered sheet is transported, but the first sheet removing concave is formed along the direction in which the sheet is transported.

Further, the first sheet removing concave is formed so as to be positioned within an area ranging from the stacking area of the maximum size sheet to the stacking area of the small size sheet. Thus, the delivered sheet stacking surface surely supports both sides of the stacked sheet that are parallel to a direction in which sheets ranging from the maximum size sheet to the minimum size sheet are delivered, so that this arrangement does not bring about the following problem: a stacking condition of the sheets on the delivered sheet stacking surface is deteriorated, so that it becomes difficult to align the sheets.

Further, in order to solve such a problem that it is difficult for the operator to insert his/her hand to the delivered sheet stacking surface when the operator performs operations standing near the image forming device, the first sheet removing concave is formed along the direction in which the sheet is transported, so that the operator can naturally and easily insert his/her hand from the lateral outside of the image forming device to the area where the sheets are stacked.

As a result, it is possible to provide a delivered sheet stacking tray and an image forming device having the delivered sheet stacking tray which realize a preferable stacking condition of sheets on a delivered stacking surface and make it easy to remove the sheets.

Further, the delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave (second sheet removing concave) which includes a line linking (ii) a corner portion of the stacking area of a maximum size sheet which corner portion is positioned on a downstream side in a transporting direction and on a front side of the image forming device to (i) a corner portion of a stacking area of a small size sheet smaller than the maximum size sheet which corner portion is positioned on the downstream side in the transporting direction and on the front side of the image forming device so that the sheet removing concave extends from the transporting-direction end of the delivered sheet stacking surface.

Further, the image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave (second sheet removing concave) which includes a line linking (ii) a corner portion of the stacking area of a maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface.

According to the invention, an end of the sheet which end is positioned on a back side of the image forming device is supported by the delivered sheet stacking surface upon delivering the sheet to the delivered sheet stacking surface.

Further, the delivered sheet stacking surface has a sheet removing concave (second sheet removing concave) which includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface.

Thus, the delivered sheet stacking surface has the second sheet removing concave which exists in a part of a direction in which the delivered sheet is transported, but the sheet removing concave is formed along the direction in which the sheet is transported.

Further, the second sheet removing concave includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device. Further, the delivered sheet stacking surface supports an end of the sheet which end is positioned on a back side of the image forming device upon delivering the sheet to the delivered sheet stacking surface.

Thus, the delivered sheet stacking surface surely supports at least one side of the stacked sheet that is parallel to a direction in which the sheets ranging from the maximum size sheet to the minimum size sheet are delivered, so that this arrangement does not bring about the following problem: a stacking condition of sheets on the delivered sheet stacking surface is deteriorated, so that it becomes difficult to align the sheets.

Further, in order to solve such a problem that it is difficult for the operator to insert his/her hand to the delivered sheet stacking surface when the operator performs operations standing near the image forming device, the second sheet removing concave is formed along the direction in which the sheet is transported, so that the operator can naturally and easily insert his/her hand from the lateral outside of the image forming device to the area where the sheets are stacked.

As a result, it is possible to provide a delivered sheet stacking tray and an image forming device having the delivered sheet stacking tray which realize a preferable stacking condition of sheets on a delivered stacking surface and make it easy to remove the sheets.

Further, the delivered sheet stacking tray of the present invention can be arranged so that the first or second sheet removing concave is formed substantially in parallel to a line linking (ii) a corner portion of the stacking area of the maximum size sheet which corner portion is positioned on a downstream side in a transporting direction and on a front side of the body of the image forming device to (i) a corner portion of the stacking area of the small size sheet which corner portion is positioned on the downstream side in the transporting direction and on the front side of the body of the image forming device.

According to the arrangement, the first or second sheet removing concave is formed substantially in parallel to a line linking (ii) a corner portion of the stacking area of the maximum size sheet which corner portion is positioned on a downstream side in a transporting direction and on a front side of the body of the image forming device to (i) a corner portion of the stacking area of the small size sheet which corner portion is positioned on the downstream side in the transporting direction and on the front side of the body of the image forming.

Thus, the first or second sheet removing concave provided on the delivered sheet stacking surface is positioned nearest to the operator, so that the operator can more naturally and more easily insert his/her hand from the lateral outside of the image forming device to the area where the sheets are stacked.

Further, the aforementioned delivered sheet stacking tray of the present invention can be arranged so that: the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the first sheet removing concave is formed on a back side of a line linking (iv) a corner portion of a stacking area of a maximum size sheet which corner portion is positioned on a downstream side in a transporting direction and on a front side of the image forming device to (iii) a corner portion of a stacking area of a small size sheet which corner portion is positioned on the downstream side in the transporting direction and on the front side of the image forming device, and the maximum size sheet is sortable upon shifting the sheet to a back side of the image forming device.

According to the arrangement, the sheet delivering means of the image forming device includes the sorting means for shifting the sheet in a vertical direction with respect to a direction in which the sheet is delivered so as to sort the sheet. Thus, it is necessary to easily remove the sheet stacked on the delivered sheet stacking surface when the sheet is shifted to a back side of the image forming device.

From this view point, in the present invention, the first sheet removing concave is formed on a back side of a line linking (iv) a corner portion of a stacking area of a maximum size sheet which corner portion is positioned on a downstream side in a transporting direction and on a front side of the image forming device to (iii) a corner portion of a stacking area of a small size sheet which corner portion is positioned on the downstream side in the transporting direction and on the front side of the image forming device, and the maximum size sheet is sortable upon shifting the sheet to a back side of the image forming device.

Thus, even though the sheet delivering means includes the sorting means for shifting the sheet in a vertical direction with respect to a direction in which the sheet is delivered so as to sort the sheet upon delivering the sheet, it is possible to easily remove the sheet stacked on the delivered sheet stacking surface.

Further, the aforementioned delivered sheet stacking tray of the present invention can be arranged so that: the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the second sheet removing concave includes a line linking (iv) a corner portion of a stacking area of a maximum size sheet which corner portion is positioned on a downstream side in a transporting direction and on a front side of the image forming device to (iii) a corner portion of a stacking area of a small size sheet which corner portion is positioned on the downstream side in the transporting direction and on the front side of the image forming device, and the maximum size sheet is sortable upon shifting the sheet to a back side of the image forming device.

According to the arrangement, the sheet delivering means of the image forming device includes the sorting means for shifting the sheet in a vertical direction with respect to a direction in which the sheet is delivered so as to sort the sheet. Thus, it is necessary to easily remove the sheet stacked on the delivered sheet stacking surface when the sheet is shifted to a back side of the image forming device.

From this view point, in the present invention, the second sheet removing concave includes a line linking (i) a corner portion of a stacking area of a maximum size sheet which corner portion is positioned on a downstream side in a transporting direction and on a front side of the image forming device to (ii) a corner portion of a stacking area of a small size sheet which corner portion is positioned on the downstream side of the transporting direction and on the front side of the image forming device, and the maximum size sheet is sortable upon shifting the sheet to a back side of the image forming device.

Thus, even though the sheet delivering means includes the sorting means for shifting the sheet in a vertical direction with respect to a direction in which the sheet is delivered so as to sort the sheet upon delivering the sheet, it is possible to easily remove the sheet stacked on the delivered sheet stacking surface.

Further, the aforementioned delivered sheet stacking tray of the present invention can be arranged so that the sheet removing concave has a width which is wider than a width of four fingers excluding a thumb folded on a palm.

According to the arrangement, the sheet removing concave has a width which is wider than a width of four fingers excluding a thumb folded on a palm, so that the operator can surely and easily insert his/her hand from the lateral outside of the image forming device to the area where the sheets are stacked.

The delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: the delivered sheet stacking surface has a sheet removing concave (third sheet removing concave) which extends from (a) the transporting-direction end via (b) a stacking area of a maximum size sheet to (c) a stacking area of a small size sheet smaller than the maximum size sheet so that the third sheet removing concave is positioned within an area ranging from the stacking area of the maximum size sheet to a stacking area of a minimum size sheet, and a width of the third sheet removing concave becomes wider toward a downstream side in a transporting direction. Note that, the width of the sheet removing concave is a width in a vertical direction with respect to the transporting direction.

Further, the image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: the delivered sheet stacking surface of the delivered sheet stacking tray has a sheet removing concave (third sheet removing concave) which extends from (a) the transporting-direction end via (b) a stacking area of a maximum size sheet to (c) a stacking area of a small size sheet smaller than the maximum size sheet so that the third sheet removing concave is positioned within an area ranging from the stacking area of the maximum size sheet to a stacking area of a small size sheet, and a width of the third sheet removing concave becomes wider toward a downstream side in a transporting direction.

According to the invention, the delivered sheet stacking surface has a first sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet.

Thus, the delivered sheet stacking surface has the third sheet removing concave which exists in a part of a direction in which the delivered sheet is transported, but the third sheet removing concave is formed along the direction in which the sheet is transported.

Further, the third sheet removing concave is formed so as to be positioned within an area ranging from the stacking area of the maximum size sheet to the stacking area of the small size sheet. Thus, the delivered sheet stacking surface surely supports both sides of the stacked sheet that are parallel to a direction in which sheets ranging from the maximum size sheet to the minimum size sheet are delivered, so that this arrangement does not bring about the following problem: a stacking condition of sheets on the delivered sheet stacking surface is deteriorated, so that it becomes difficult to align the sheets.

Further, the width of the third sheet removing concave becomes wider toward a downstream side in a transporting direction, so that it is possible to easily remove sheets ranging from the minimum size sheet to the maximum size sheet for example.

Further, in order to solve such a problem that it is difficult for the operator to insert his/her hand to the delivered sheet stacking surface when the operator performs operations standing near the image forming device, the third sheet removing concave is formed along the direction in which the sheet is transported, and the width of the third sheet removing concave becomes wider toward a downstream side in a transporting direction, so that the operator can naturally and easily insert his/her hand from the lateral outside of the image forming device to the area where the sheets are stacked.

As a result, it is possible to provide a delivered sheet stacking tray and an image forming device having the delivered sheet stacking tray which realize a preferable stacking condition of sheets on a delivered stacking surface and make it easy to remove the sheets.

The delivered sheet stacking tray of the present invention includes a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave (fourth sheet removing concave) which includes a line linking (ii) a corner portion of the stacking area of a maximum size sheet which corner portion is positioned on a downstream side in a transporting direction and on a front side of the image forming device to (i) a corner portion of a stacking area of a small size sheet smaller than the maximum size sheet which corner portion is positioned on the downstream side in the transporting direction and on the front side of the image forming device so that the fourth sheet removing concave extends from the transporting-direction end of the delivered sheet stacking surface, and a width of the fourth sheet removing concave becomes wider toward a downstream side in a transporting direction.

Further, the image forming device of the present invention includes: image forming means for forming an image on a sheet; sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein: an end of the sheet which end is positioned on a back side of the image forming device is supported by the delivered sheet stacking surface upon delivering the sheet to the delivered sheet stacking surface, and the delivered sheet stacking surface has a sheet removing concave (fourth sheet removing concave) which includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the fourth sheet removing concave extends from the transporting-direction end of the delivered sheet stacking surface, and a width of the fourth sheet removing concave becomes wider toward a downstream side in the transporting direction.

According to the invention, an end of the sheet which end is positioned on a back side of the image forming device is supported by the delivered sheet stacking surface upon delivering the sheet to the delivered sheet stacking surface. While, the delivered sheet stacking surface has the fourth sheet removing concave which includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the fourth sheet removing concave extends from the transporting-direction end of the delivered sheet stacking surface.

Thus, the delivered sheet stacking surface has the fourth sheet removing concave which exists in a part of a direction in which the delivered sheet is transported, but the fourth sheet removing concave is formed along the direction in which the sheet is transported.

Further, the fourth sheet removing concave includes a line linking (ii) a corner portion of the stacking area of the maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device. Thus, the delivered sheet stacking surface surely supports both sides of the stacked sheet that are parallel to a direction in which sheets ranging from the maximum size sheet to the minimum size sheet are delivered, so that this arrangement does not bring about the following problem: a stacking condition of sheets on the delivered sheet stacking surface is deteriorated, so that it becomes difficult-to align the sheets.

Further, the width of the fourth sheet removing concave becomes wider toward a downstream side in a transporting direction, so that it is possible to easily remove sheets ranging from the minimum size sheet to the maximum size sheet for example.

Further, in order to solve such a problem that it is difficult for the operator to insert his/her hand to the delivered sheet stacking surface when the operator performs operations standing near the image forming device, the fourth sheet removing concave is formed along the direction in which the sheet is transported, and becomes wider toward a downstream side in a transporting direction, so that the operator can naturally and easily insert his/her hand from the lateral outside of the image forming device to the area where the sheets are stacked.

As a result, it is possible to provide a delivered sheet stacking tray and an image forming device having the delivered sheet stacking tray which realize a preferable stacking condition of sheets on a delivered stacking surface and make it easy to remove the sheets.

Further, the aforementioned delivered sheet stacking tray of the present invention can be arranged so that an edge of the third or fourth sheet removing concave which edge is positioned on a front side of the image forming device approaches the front side of the image forming device as the sheet removing concave extends from (a) the downstream side of the stacking area of the small size sheet in the transporting direction to (b) the downstream side of the stacking area of the maximum size sheet in the transporting direction. Note that, the front side of the image forming device is a side on which the operator stands upon using the image forming device, that is, an operation side of the image forming device.

According to the foregoing description, the edge of the third or fourth sheet removing concave which edge is positioned on the front side of the image forming device approaches the front side of the image forming device as the sheet removing concave extends from (a) the downstream side of the stacking area of the small size sheet in the transporting direction to (b) the downstream side of the stacking area of the maximum size sheet in the transporting direction.

Thus, a portion through which the operator inserts his/her hand into the third or fourth sheet removing concave provided on the delivered sheet stacking surface is positioned nearest to the operator standing on the operation side of the image forming device, so that the operator can naturally and easily insert his/her hand from the lateral outside of the image forming device to an area where the sheets are stacked. Thus, it is possible to easily remove the sheets.

Further, the aforementioned delivered sheet stacking tray of the present invention can be arranged so that at least an edge of the third or fourth sheet removing concave which edge is positioned on a front side of the image forming device is formed substantially in parallel to a line linking (ii) a corner portion of the stacking area of the maximum size sheet which corner portion is positioned on a downstream side in a transporting direction and on a front side of the image forming device to (i) a corner portion of a stacking area of the small size sheet which corner portion is positioned on the downstream side in the transporting direction and on the front side of the image forming device.

According to the invention, the third or fourth sheet removing concave is formed substantially in parallel to a line linking (ii) a corner portion of the stacking area of the maximum size sheet which corner portion is positioned on a downstream side in a transporting direction and on a front side of the image forming device to (i) a corner portion of a stacking area of the small size sheet which corner portion is positioned on the downstream side in the transporting direction and on the front side of the image forming device.

Thus, the sheet stacking surface surely supports both sides of any size sheet, so that it is possible to keep a preferable stacking condition of sheets on the delivered sheet stacking surface. Further, the third or fourth sheet removing concave provided on the delivered sheet stacking surface is positioned nearest to the operator standing on the front side of the image forming device, so that the operator can naturally and easily insert his/her hand from the lateral outside of the image forming device to the area where the sheets are stacked. Thus, it is possible to easily remove the sheets.

Further, the aforementioned delivered sheet stacking tray of the present invention can be arranged so that an edge of the third or fourth sheet removing concave which edge is positioned on a back side of the image forming device approaches a front side of the image forming device as the sheet removing concave extends from (a) the downstream side of the stacking area of the small size sheet in the transporting direction to (b) the downstream side of the stacking area of the maximum size sheet in the transporting direction.

According to the arrangement, the edge of the third or fourth sheet removing concave which edge is positioned on the back side of the image forming device is formed so that a stacking area of the sheet becomes wider as the sheet removing concave extends from (a) the downstream side of the stacking area of the minimum size sheet in the transporting direction to (b) the downstream side of the stacking area of the maximum size sheet in the transporting direction.

Thus, a back side area of the image forming device which supports the sheet is wider, so that it is possible to prevent the sheet from drooping to the third or fourth sheet removing concave. As a result, it is possible to keep a preferable stacking condition of the sheets.

Further, the aforementioned delivered sheet stacking tray of the present invention can be arranged so that the sheet delivering means has sorting means for shifting the sheet in a back direction or a forth direction of the image forming device which is a vertical direction with respect to a direction in which the sheet is delivered so as to sort the sheet upon delivering the sheet, and the third sheet removing concave is formed on a back side of a line linking (iv) a corner portion of a stacking area of a maximum size sheet which corner portion is positioned on a downstream side in a transporting direction and on a front side of the image forming device to (i, iii) a corner portion of a stacking area of a small size sheet which corner portion is positioned on the downstream side of the transporting direction and on the front side of the image forming device, and the maximum size sheet is sortable upon shifting the sheet to a back side of the image forming device.

According to the arrangement, the sheet delivering means of the image forming device includes the sorting means for shifting the sheet in a vertical direction with respect to a direction in which the sheet is delivered so as to sort the sheet. Thus, it is necessary to easily remove the sheet stacked on the delivered sheet stacking surface when the sheet is shifted to a back side of the image forming device.

From this view point, in the present invention, the third sheet removing concave is formed on a back side of a line linking (iv) a corner portion of a stacking area of a maximum size sheet which corner portion is positioned on a downstream side in a transporting direction and on a front side of the image forming device to (iii) a corner portion of a stacking area of a small size sheet which corner portion is positioned on the downstream side of the transporting direction and on the front side of the image forming device, and the maximum size sheet is sortable upon shifting the sheet to a back side of the image forming device.

Thus, even though the sheet delivering means includes the sorting means for shifting the sheet in a vertical direction with respect to a direction in which the sheet is delivered so as to sort the sheet upon delivering the sheet, it is possible to stably support the sheet by forming the concave which makes it possible to support the both sides parallel to a sheet delivering direction with a shift amount taken into consideration. Thus, it is possible to keep a preferable stacking condition of the sheet. Further, it is possible to easily remove the sheet stacked on the delivered sheet stacking surface.

Further, the aforementioned delivered sheet stacking tray of the present invention can be arranged so that: the sheet delivering means has sorting means for shifting the sheet in a back direction or a forth direction of the image forming device which is a vertical direction with respect to a direction in which the sheet is delivered so as to sort the sheet upon delivering the sheet, and the sheet removing concave includes a line linking (iv) a corner portion of a stacking area of a maximum size sheet which corner portion is positioned on a downstream side in a transporting direction and on a front side of the image forming device to (i, iii) a corner portion of a stacking area of a small size sheet which corner portion is positioned on the downstream side of the transporting direction and on the front side of the image forming device, and the maximum size sheet is sortable upon shifting the sheet to a back side of the image forming device.

According to the arrangement, the sheet delivering means of the image forming device includes the sorting means for sorting the sheet by shifting the sheet in a back direction or a forth direction of the image forming device, i.e., in a vertical direction with respect to a direction in which the sheet is delivered so as to sort the sheet upon delivering the sheet. Thus, it is necessary to easily remove the sheet stacked on the delivered sheet stacking surface when the sheet is shifted to a back side of the image forming device.

From this view point, in the present invention, the fourth sheet removing concave includes a line linking (iv) a corner portion of a stacking area of a maximum size sheet which corner portion is positioned on a downstream side in a transporting direction and on a front side of the image forming device to (iii) a corner portion of a stacking area of a small size sheet which corner portion is positioned on the downstream side in the transporting direction and on the front side of the image forming device, and the maximum size sheet is sortable upon shifting the sheet to a back side of the image forming device.

Thus, even though the sheet delivering means includes the sorting means for shifting the sheet in a vertical direction with respect to a direction in which the sheet is delivered so as to sort the sheet upon delivering the sheet, it is possible to stably support the sheet by forming the concave which makes it possible to support the both sides parallel to a sheet-delivering direction with a shift amount taken into consideration. Thus, it is possible to keep a preferable stacking condition of the sheet. Further, it is possible to easily remove the sheet stacked on the delivered sheet stacking surface.

Further, the aforementioned delivered sheet stacking tray of the present invention can be arranged so that the transporting-direction end of the third or fourth sheet removing concave is opened toward a lateral outside of the image forming device.

According to the arrangement, the transporting-direction end of the third or fourth sheet removing concave is opened toward a lateral outside of the image forming device, so that the operator can naturally and easily insert his/her hand from the lateral outside of the image forming device to the area where the sheets are stacked. Further, even when an image reading device is provided above the delivered sheet stacking tray for example, it is possible to confirm a position of the third or fourth sheet removing concave, so that it is possible to easily remove the sheet.

Further, the aforementioned delivered sheet stacking tray of the present invention can be arranged so that one or more sheet droop prevention convexes each of which extends in the transporting direction are provided on a bottom face of the third or fourth sheet removing concave.

According to the arrangement, one or more sheet droop prevention convexes each of which extends in the transporting direction are provided on the bottom face of the third or fourth sheet removing concave.

Thus, the convex such as a rib is provided on the bottom face of the third or fourth sheet removing concave, so that it is possible to prevent a large-size sheet from drooping to the third or fourth sheet removing concave even when the width of the sheet removing concave is made wider so as to make it easy to insert the operator's hand. Thus, this hardly brings about the following problems: the sheet droops to the third or fourth sheet removing concave, so that it is difficult to remove the sheet; and a condition under which the sheets are stacked is deteriorated.

Further, the aforementioned delivered sheet stacking tray of the present invention can be arranged so that the sheet droop prevention convex approaches the front side of the image forming device as the sheet droop prevention convex extends toward the downstream side in the transporting direction.

According to the arrangement, the sheet droop prevention convex approaches the front side of the image forming device as the sheet droop prevention convex extends toward the downstream side in the transporting direction. That is, the sheet droop prevention convex is formed so as to be away from the operation side of the image forming device as it extends toward a center of a transport line of the minimum size sheet, in the same manner as in movement of the operator's hand inserted to the third or fourth sheet removing concave.

Thus, this arrangement hardly brings about such a problem that: the sheet droop prevention convex prevents the operator from inserting his/her hand to the third or fourth sheet removing concave.

Further, the aforementioned delivered sheet stacking tray of the present invention can be arranged so that the sheet droop prevention convexes are provided in plurality on the bottom face of the third or fourth sheet removing concave, and one of the sheet droop prevention convexes which is positioned near the front side of the image forming device approaches the front side of the image forming device as the sheet droop prevention convex extends toward the downstream side in the transporting direction.

According to the arrangement, the sheet droop prevention convexes are provided in plurality on the bottom face of the sheet removing concave, and one of the sheet droop prevention convexes which is positioned near the front side of the image forming device approaches the front side of the image forming device as the sheet droop prevention convex extends toward the downstream side in the transporting direction.

Thus, it is possible to prevent a large-size sheet from drooping to the third or fourth sheet removing concave even when the width of the sheet removing concave is made wider so as to make it easy to insert the operator's hand. Further, this arrangement hardly brings about such a problem that: the sheet droop prevention convex prevents the operator from inserting his/her hand to the third or fourth sheet removing concave.

Further, the aforementioned delivered sheet stacking tray of the present invention can be arranged so that the sheet droop prevention convex extends further than an end of the stacking area of the maximum size sheet in the transporting direction.

According to the arrangement, the sheet droop prevention convex extends further than an end of the stacking area of the maximum size sheet in the transporting direction.

In a case where the sheet droop prevention convex is positioned under the maximum size sheet, there occurs such a trouble that: when the operator inserts his/her fingers under the sheet, a fingertip touches the sheet droop prevention convex. However, the sheet droop prevention convex extends further than the stacking area of the maximum size sheet toward the downstream side in the transport direction, so that a part of the sheet droop prevention convex protrudes from-the maximum size sheet even when the maximum size sheet is stacked. As a result, it is possible to see the sheet droop prevention convex. Thus, it is possible to confirm where the sheet droop prevention convex exists, so that it is possible to prevent the fingertip from touching the sheet droop prevention convex when the operator inserts his/her fingers under the sheet.

Further, the aforementioned delivered sheet stacking tray of the present invention can be arranged so that a height of the sheet droop prevention convex becomes lower as the sheet droop prevention convex extends from the upstream side toward the downstream side in the transporting direction.

According to the arrangement, a height of the sheet droop prevention convex becomes lower as the sheet droop prevention convex extends from the upstream side toward the downstream side in the transporting direction, so that it is possible to prevent the fingertip from touching the sheet droop prevention convex when the operator inserts his/her finger into the third or fourth sheet removing concave upon removing the sheets.

Further, the aforementioned delivered sheet stacking tray of the present invention can be arranged so that a minimum gap between the sheet droop prevention convex and the edge of the third sheet removing concave is wider than a width of a finger, and a minimum gap between the sheet droop prevention convex and the edge of the fourth sheet removing concave is wider than the width of the finger, and a minimum gap between the sheet droop prevention convexes adjacent to each other is wider than the width of the finger.

According to the arrangement, a minimum gap between the sheet droop prevention convex and the edge of the third sheet removing concave is wider than a width of a finger, and a minimum gap between the sheet droop prevention convex and the edge of the fourth sheet removing concave is wider than the width of the finger, and a minimum gap between the sheet droop prevention convexes adjacent to each other is wider than the width of the finger, so that the operator's finger can pass through a gap between the sheet droop prevention convex and the edge of the third sheet removing concave, and the operator's finger can pass through a gap between the sheet droop prevention convex and the edge of the fourth sheet removing concave, and the operator's finger can pass through a gap between the sheet droop prevention convexes adjacent to each other, when the operator inserts his/her hand to the third or fourth sheet removing concave upon removing the sheets. Thus, it is possible to easily hold the sheets and to prevent the fingertip from touching the sheet droop prevention convex.

Further, the aforementioned delivered sheet stacking tray of the present invention can be arranged so that the image forming device includes document reading means provided above the delivered sheet stacking surface with a space between the document reading means and the delivered sheet stacking surface.

Further, the image forming device of the present invention can be arranged so that a body of the image forming device includes document reading means provided above the delivered sheet stacking surface with a space between the document reading means and the delivered sheet stacking surface.

According to the arrangement, the body of the image forming device includes the document reading means provided above the delivered sheet stacking surface with a space between the document reading means and the delivered sheet stacking surface.

Thus, even when the image reading device is provided on an upside of the image forming device, the delivered sheet stacking surface surely supports at least one side of both sides of the stacked sheet that are parallel to a direction in which the sheets ranging from the maximum size sheet to the minimum size sheet are delivered, so that this arrangement hardly brings about the following problem: a condition under which the sheets are stacked on the delivered sheet stacking surface is deteriorated, so that it becomes difficult to align the sheets.

Further, in order to solve such a problem that the document reading means provided on an upside of the image forming device makes it difficult for the operator to insert his/her hand to the delivered sheet stacking surface when the operator performs operations standing near the image forming device, the sheet removing concave (any one of the first to fourth sheet removing concaves) is formed along the direction in which the sheet is transported, and the width of each of the first to fourth sheet removing concaves becomes wider as it extends toward the downstream side in the transporting direction, so that the operator can naturally and easily insert his/her hand from the lateral outside of the image forming device to the area where the sheets are stacked.

As a result, it is possible to provide the delivered sheet stacking tray and the image forming device having the delivered sheet stacking tray which realize a preferable stacking condition of sheets on the delivered sheet stacking surface and make it easy to remove the sheets.

The invention being thus described, it will be obvious that the same may be varied in many ways. Such variations are not to be regarded as a departure from the spirit and scope of the invention, and all such modifications as would be obvious to one skilled in the art intended to be included within the scope of the following claim.

What is claimed is:

1. A delivered sheet stacking tray, comprising a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein:

the delivered sheet stacking surface has a sheet removing concave which extends from (a) the transporting-direction end via (b) a stacking area of a maximum size sheet to (c) a stacking area of a sheet smaller than the maximum size sheet so that the sheet removing concave is positioned within an area ranging from the stacking area of the maximum size sheet to the stacking area of the small size sheet, and the sheet removing concave is formed substantially in parallel to a line linking (ii) a corner portion of the stacking area of the maximum size sheet which corner portion is positioned on a downstream side in a transporting direction and on a front side of the image forming device to (i) a corner portion of the stacking area of the small size sheet which corner portion is positioned on the downstream side in the transporting direction and on the front side of the image forming device.

2. The delivered sheet stacking tray as set forth in claim 1, wherein the sheet removing concave has a width which is wider than a width of four fingers excluding a thumb folded on a palm.

3. The delivered sheet stacking tray as set forth in claim 1, wherein the image forming device includes document reading means provided above the delivered sheet stacking surface with a space between the document reading means and the delivered sheet stacking surface.

4. An image forming device, comprising:

image forming means for forming an image on a sheet;

sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein:

the delivered sheet stacking surface of the delivered sheet stacking tray has a sheet removing concave which extends from (a) the transporting-direction end via (b)

a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and the sheet removing concave is formed substantially in parallel to a line linking (ii) a corner portion of the stacking area of the maximum size sheet which corner portion is positioned on a downstream side in a transporting direction and on a front side of the body of the image forming device to (i) a corner portion of the stacking area of the small size sheet which corner portion is positioned on the downstream side in the transporting direction and on the front side of the body of the image forming device.

5. The image forming device as set forth in claim 4, wherein the body of the image forming device includes document reading means provided above the delivered sheet stacking surface with a space between the document reading means and the delivered sheet stacking surface.

6. A delivered sheet stacking tray, comprising a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein:

the delivered sheet stacking surface of the delivered sheet stacking tray has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the sheet removing concave is formed on a back side of a line linking (iv) a corner portion of the stacking area of the maximum size sheet which corner portion is positioned on a downstream side in a transporting direction and on a front side of the image forming device to (i, iii) a corner portion of the stacking area of the small size sheet which corner portion is positioned on the downstream side in the transporting direction and on the front side of the image forming device, said maximum size sheet being sortable upon shifting the sheet to a back side of the image forming device.

7. The delivered sheet stacking tray as set forth in claim 6, wherein the sheet removing concave has a width which is wider than a width of four fingers excluding a thumb folded on a palm.

8. The delivered sheet stacking tray as set forth in claim 6, wherein the image forming device includes document reading means provided above the delivered sheet stacking surface with a space between the document reading means and the delivered sheet stacking surface.

9. An image forming device, comprising:

image forming means for forming an image on a sheet;

sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein:

the delivered sheet stacking surface of the delivered sheet stacking tray has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the sheet removing concave is formed on a back side of a line linking (iv) a corner portion of the stacking area of the maximum size sheet which corner portion is positioned on a downstream side in a transporting direction and on a front side of the body of the image forming device to (i, iii) a corner portion of the stacking area of the small size sheet which corner portion is positioned on the downstream side in the transporting direction and on the front side of the body of the image forming device, said maximum size sheet being sortable upon shifting the sheet to a back side of the image forming device.

10. The image forming device as set forth in claim 9, wherein the body of the image forming device includes document reading means provided above the delivered sheet stacking surface with a space between the document reading means and the delivered sheet stacking surface.

11. A delivered sheet stacking tray, comprising a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein:

an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of a stacking area of a maximum size sheet which corner portion is positioned on a downstream side in a transporting direction and on a front side of the image forming device to (i) a corner portion of a stacking area of a small size sheet smaller than the maximum size sheet which corner portion is positioned on the downstream side in the transporting direction and on the front side of the image forming device so that the sheet removing concave extends from the transporting-direction end of the delivered sheet stacking surface.

12. The delivered sheet stacking tray as set forth in claim 11, wherein the sheet removing concave is formed substantially in parallel to the line linking (ii) the corner portion of the stacking area of the maximum size sheet which corner portion is positioned on the downstream side in the transporting direction and on the front side of the image forming device to (i) the corner portion of the stacking area of the small size sheet which corner portion is positioned on the downstream side in the transporting direction and on the front side of the image forming device.

13. The delivered sheet stacking tray as set forth in claim 11, wherein:

the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the sheet removing concave includes the line linking (iv) the corner portion of the stacking area of the maximum size sheet which corner portion is positioned on the downstream side in the transporting direction and on the front side of the image forming device to (i, iii) the corner portion of the stacking area of the small size sheet which corner portion is positioned on the downstream side in the transporting direction and on the front side of the image forming device, said maximum size sheet being sortable upon shifting the sheet to a back side of the image forming device.

14. The delivered sheet stacking tray as set forth in claim 11, wherein the sheet removing concave has a width which is wider than a width of four fingers excluding a thumb folded on a palm.

15. The delivered sheet stacking tray as set forth in claim 11, wherein the image forming device includes document reading means provided above the delivered sheet stacking surface with a space between the document reading means and the delivered sheet stacking surface.

16. An image forming device, comprising:

image forming means for forming an image on a sheet;

sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein:

an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of a stacking area of a maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface.

17. The image forming device as set forth in claim 16, wherein the body of the image forming device includes document reading means provided above the delivered sheet stacking surface with a space between the document reading means and the delivered sheet stacking surface.

18. A delivered sheet stacking tray, comprising a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein:

the delivered sheet stacking surface has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and a width of the sheet removing concave becomes wider toward a downstream side in a transporting direction.

19. The delivered sheet stacking tray as set forth in claim 18, wherein an edge of the sheet removing concave which edge is positioned on a front side of the image forming device approaches the front side of the image forming device as the sheet removing concave extends from (a) the downstream side of the stacking area of the small size sheet in the transporting direction to (b) the downstream side of the stacking area of the maximum size sheet in the transporting direction.

20. The delivered sheet stacking tray as set forth in claim 18, wherein at least an edge of the sheet removing concave which edge is positioned on a front side of the image forming device is formed substantially in parallel to a line linking (ii) a corner portion of the stacking area of the maximum size sheet which corner portion is positioned on a downstream side in a transporting direction and on a front side of the image forming device to (i) a corner portion of the stacking area of the small size sheet which corner portion is positioned on the downstream side in the transporting direction and on the front side of the image forming device.

21. The delivered sheet stacking tray as set forth in claim 18, wherein an edge of the sheet removing concave which edge is positioned on a back side of the image forming device approaches a front side of the image forming device as the sheet removing concave extends from (a) the downstream side of the stacking area of the small size sheet in the transporting direction to (b) the downstream side of the stacking area of the maximum size sheet in the transporting direction.

22. The delivered sheet stacking tray as set forth in claim 18, wherein:

the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the sheet removing concave is formed on a back side of a line linking (iv) a corner portion of the stacking area of the maximum size sheet which corner portion is positioned on the downstream side in the transporting direction and on a front side of the image forming device to (i, iii) a corner portion of the stacking area of the small size sheet which corner portion is positioned on the downstream side in the transporting direction and on the front side of the image forming device, said maximum size sheet being sortable upon shifting the sheet to a back side of the image forming device.

23. The delivered sheet stacking tray as set forth in claim 18, wherein the transporting-direction end of the sheet removing concave is opened toward the lateral outside of the image forming device.

24. The delivered sheet stacking tray as set forth in claim 18, wherein the image forming device includes document reading means provided above the delivered sheet stacking surface with a space between the document reading means and the delivered sheet stacking surface.

25. The delivered sheet stacking tray as set forth in claim 18, wherein one or more sheet droop prevention convexes each of which extends in the transporting direction are provided on a bottom face of the sheet removing concave.

26. The delivered sheet stacking tray as set forth in claim 25, wherein the sheet droop prevention convex approaches the front side of the image forming device as the sheet droop prevention convex extends toward the downstream side in the transporting direction.

27. The delivered sheet stacking tray as set forth in claim 25, wherein:

the sheet droop prevention convexes are provided in plurality on the bottom face of the sheet removing concave, and one of the sheet droop prevention convexes which is positioned near the front side of the image forming device approaches the front side of the image forming device as the sheet droop prevention convex extends toward the downstream side in the transporting direction.

28. The delivered sheet stacking tray as set forth in claim 25, wherein a minimum gap between the sheet droop prevention convex and the edge of the sheet removing concave is wider than a width of a finger, and a minimum gap between the sheet droop prevention convexes adjacent to each other is wider than the width of the finger.

29. The delivered sheet stacking tray as set forth in claim 25, wherein the sheet droop prevention convex extends further than an end of the stacking area of the maximum size sheet in the transporting direction.

30. The delivered sheet stacking tray as set forth in claim 29, wherein a height of the sheet droop prevention convex becomes lower as the sheet droop prevention convex extends from the upstream side toward the downstream side in the transporting direction.

31. An image forming device, comprising:

image forming means for forming an image on a sheet;

sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein:

the delivered sheet stacking surface of the delivered sheet stacking tray has a sheet removing concave which extends from (a) the transporting-direction end via (b) a stacking area of a maximum size sheet to (c) a stacking area of a small size sheet smaller than the maximum size sheet so that the sheet removing concave is positioned within an area ranging from the stacking area of the maximum size sheet to the stacking area of the small size sheet, and a width of the sheet removing concave becomes wider toward a downstream side in a transporting direction.

32. The image forming device as set forth in claim 31, wherein the body of the image forming device includes document reading means provided above the delivered sheet stacking surface with a space between the document reading means and the delivered sheet stacking surface.

33. A delivered sheet stacking tray, comprising a delivered sheet stacking surface, provided on an upside of an image forming device so as to stack a sheet delivered from sheet delivering means of the image forming device, which extends in a direction in which the sheet is transported so that at least a transporting-direction end of the delivered sheet stacking surface is opened toward a lateral outside of the image forming device, wherein:

an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of a stacking area of a maximum size sheet which corner portion is positioned on a downstream side in a transporting direction and on a front side of the image forming device to (i) a corner portion of a stacking area of a small size sheet smaller than the maximum size sheet which corner portion is positioned on the downstream side in the transporting direction and on the front side of the image forming device so that the sheet removing concave extends from the transporting-direction end of the delivered sheet stacking surface, and a width of the sheet removing concave becomes wider toward the downstream side in the transporting direction.

34. The delivered sheet stacking tray as set forth in claim 33, wherein an edge of the sheet removing concave which edge is positioned on the front side of the image forming device approaches the front side of the image forming device as the sheet removing concave extends from (a) the downstream side of the stacking area of the small size sheet in the transporting direction to (b) the downstream side of the stacking area of the maximum size sheet in the transporting direction.

35. The delivered sheet stacking tray as set forth in claim 33, wherein at least an edge of the sheet removing concave which edge is positioned on the front side of the image forming device is formed substantially in parallel to the line linking (ii) the corner portion of the stacking area of the maximum size sheet which corner portion is positioned on the downstream side in the transporting direction and on the front side of the image forming device to (i) the corner portion of the stacking area of the small size sheet which corner portion is positioned on the downstream side in the transporting direction and on the front side of the image forming device.

36. The delivered sheet stacking tray as set forth in claim 33, wherein an edge of the sheet removing concave which edge is positioned on a back side of the image forming device approaches the front side of the image forming device as the sheet removing concave extends from (a) the downstream side of the stacking area of the small size sheet in the transporting direction to (b) the downstream side of the stacking area of the maximum size sheet in the transporting direction.

37. The delivered sheet stacking tray as set forth in claim 33, wherein:

the sheet delivering means has sorting means for sorting the sheet by shifting the sheet in a back direction or a forth direction of the image forming device which is a vertical direction with respect to a direction in which the sheet is delivered so as to sort the sheet upon delivering the sheet, and the sheet removing concave includes the line linking (iv) the corner portion of the stacking area of the maximum size sheet which corner portion is positioned on the downstream side in the transporting direction and on the front side of the image forming device to (i, iii) the corner portion of the stacking area of the small size sheet which corner portion is positioned on the downstream side in the transporting direction and on the front side of the image forming device, said maximum size sheet being sortable upon shifting the sheet to a back side of the image forming device.

38. The delivered sheet stacking tray as set forth in claim 33, wherein the transporting-direction end of the sheet removing concave is opened toward the lateral outside of the image forming device.

39. The delivered sheet stacking tray as set forth in claim 33, wherein the image forming device includes document reading means provided above the delivered sheet stacking surface with a space between the document reading means and the delivered sheet stacking surface.

40. The delivered sheet stacking tray as set forth in claim 33, wherein one or more sheet droop prevention convexes each of which extends in the transporting direction are provided on a bottom face of the sheet removing concave.

41. The delivered sheet stacking tray as set forth in claim 33, wherein the sheet droop prevention convex approaches the front side of the image forming device as the sheet droop prevention convex extends toward the downstream side in the transporting direction.

42. The delivered sheet stacking tray as set forth in claim 40, wherein:

the sheet droop prevention convexes are provided in plurality on the bottom face of the sheet removing concave, and one of the sheet droop prevention convexes which is positioned near the front side of the image forming device approaches the front side of the image forming device as the sheet droop prevention convex extends toward the downstream side in the transporting direction.

43. The delivered sheet stacking tray as set forth in claim 40, wherein a minimum gap between the sheet droop prevention convex and the edge of the sheet removing concave is wider than a width of a finger, and a minimum gap between the sheet droop prevention convexes adjacent to each other is wider than the width of the finger.

44. The delivered sheet stacking tray as set forth in claim 40, wherein the sheet droop prevention convex extends further than an end of the stacking area of the maximum size sheet in the transporting direction.

45. The delivered sheet stacking tray as set forth in claim 44, wherein a height of the sheet droop prevention convex becomes lower as the sheet droop prevention convex extends from the upstream side toward the downstream side in the transporting direction.

46. An image forming device comprising:

image forming means for forming an image on a sheet;

sheet delivering means for delivering the sheet on which the image has been formed by the image forming means; and a delivered sheet stacking tray having a delivered sheet stacking surface, provided so as to stack the sheet delivered from the sheet delivering means, which extends in a direction in which the sheet is transported so that at least a transporting-direction end of the delivered sheet stacking surface is opened toward a lateral outside of a body of the image forming device, wherein:

an end of the sheet which end is positioned on a back side of the image forming device is supported by the delivered sheet stacking surface upon delivering the sheet to the delivered sheet stacking surface, and the delivered sheet stacking surface has a sheet removing concave which includes a line linking (ii) a corner portion of the stacking area of a maximum size sheet which corner portion is positioned on a downstream side in a transporting direction and on a front side of the body of the image forming device to (i) a corner portion of a stacking area of a small size sheet smaller than the maximum size sheet which corner portion is positioned on the downstream side in the transporting direction and on the front side of the body of the image forming device so that the sheet removing concave extends from the transporting-direction end of the delivered sheet stacking surface, and a width of the sheet removing concave becomes wider toward the downstream side in the transporting direction.

47. The image forming device as set forth in claim 46, wherein the body of the image forming device includes document reading means provided above the delivered sheet stacking surface with a space between the document reading means and the delivered sheet stacking surface.

* * * * *